US006336836B1

(12) United States Patent
Suzuki et al.

(10) Patent No.: US 6,336,836 B1
(45) **Date of Patent: *Jan. 8, 2002**

(54) METHOD OF MANUFACTURING ELECTRON-BEAM SOURCE AND IMAGE FORMING APPARATUS USING SAME, AND ACTIVATION PROCESSING METHOD

(75) Inventors: Noritake Suzuki, Atsugi; Hidetoshi Suzuki, Fujisawa; Eiji Yamaguchi, Zama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 3 days.

(21) Appl. No.: 08/584,689

(22) Filed: Jan. 11, 1996

(30) Foreign Application Priority Data

| | | |
|---|---|---|
| Jan. 13, 1995 | (JP) | 7-004025 |
| Sep. 7, 1995 | (JP) | 7-230022 |
| Nov. 27, 1995 | (JP) | 7-307291 |

(51) Int. Cl.[7] ..... H01J 9/02
(52) U.S. Cl. ..... 445/6; 445/50
(58) Field of Search ..... 445/24, 50, 6; 313/336; 427/77, 78

(56) References Cited

U.S. PATENT DOCUMENTS

| | | | | |
|---|---|---|---|---|
| 4,849,674 A | | 7/1989 | Cherry et al. | 313/509 |
| 5,066,883 A | | 11/1991 | Yoshioka et al. | 313/309 |
| 5,185,554 A | | 2/1993 | Nomura et al. | 313/495 |
| 5,209,687 A | | 5/1993 | Konishi | 445/6 |
| 5,455,597 A | | 10/1995 | Nakamura et al. | 345/75 |
| 5,591,061 A | * | 1/1997 | Ikeda et al. | 445/3 |
| 5,593,335 A | * | 1/1997 | Suzuki et al. | 445/50 |
| 5,597,338 A | * | 1/1997 | Iwai et al. | 427/77 |
| 5,627,111 A | * | 5/1997 | Tsukamoto et al. | 427/77 X |

FOREIGN PATENT DOCUMENTS

| | | |
|---|---|---|
| EP | 0620581 | 10/1994 |
| EP | 0660357 | 6/1995 |
| JP | 6431332 | 2/1989 |
| JP | 7-320631 | 12/1995 |

OTHER PUBLICATIONS

W.P. Dyke, et al., "Field Emission", Advances in Electronics and Electron Physics, vol. VIII, pp. 89–185 (1956).
C.A. Spindt, et al., "Physical Properties of Thin–Film Field Emission Cathodes with Molybdenum Cones", vol. 47, No. 12, pp. 5248–5263 (Dec. 1976).
C.A. Mead, "Operation of Tunnel–Emission Devices", Journal of Applied Physics, vol. 32, No. 4, pp. 646–652 (Apr. 1961).
M.I. Elinson, et al., "The Emission of Hot Electrons and the Field Emission of Electrons From Tin Oxide", Radio Engineering and Electronic Physics, No. 7, pp. 1290–1296 (Jul. 1965).
G. Dittmer, "Electrical Conduction and Electron Emission of Discontinuous Thin Films", Thin Solid Films, vol. 9, pp. 317–328 (1972).
M. Hartwell, et al., "Strong Electron Emission From Patterned Tin–Indium Oxide Thin Films", International Electron Devices Meeting, pp. 519–521 (1975).
H. Araki, et al., "Electroforming and Electron Emission of Carbon Thin Films", Journal of the Vacuum Society of Japan, vol. 26, No. 1, pp. 22–29 (Jan. 26, 1983).

* cited by examiner

*Primary Examiner*—Kenneth J. Ramsey
(74) *Attorney, Agent, or Firm*—Fitzpatrick, Cella, Harper & Scinto

(57) ABSTRACT

When manufacturing an electron-beam source, an activation is performed to generate activation material at a plurality of electron-emitting devices. The activation is generated by dividing the plurality of electron-emitting devices into plural groups and sequentially applying voltage to each group.

52 Claims, 34 Drawing Sheets

R : RED FLUORESCENT SUBSTANT
G : GREEN FLUORESCENT SUBSTANT
B : BLUE FLUORESCENT SUBSTANT

R : RED FLUORESCENT SUBSTANT
G : GREEN FLUORESCENT SUBSTANT
B : BLUE FLUORESCENT SUBSTANT

METHOD OF MANUFACTURING ELECTRON-BEAM SOURCE AND IMAGE FORMING APPARATUS USING SAME, AND ACTIVATION PROCESSING METHOD

BACKGROUND OF THE INVENTION

This invention relates to a method of manufacturing an electron-beam source having a plurality of electron-emitting devices and an image forming apparatus using the electron-beam source and an activation processing method.

Conventionally, two type of electron-beam sources, namely thermionic cathodes and cold cathode electron-beam sources, are known as electron-emitting devices. Examples of cold cathode electron-beam sources are electron-emitting devices of field emission type (hereinafter abbreviated to "FE"), metal/insulator/metal type (hereinafter abbreviated to "MIM") and surface-conduction emission type (hereinafter abbreviated to "SCE").

Known examples of the FE type electron-emitting devices are described by W. P. Dyke and W. W. Dolan, "Field Emission", Advance in Electron Physics, 8, 89 (1956) and by C. A. Spindt, "Physical properties of thin-film field emission cathodes with molybdenum cones", J. Appl. Phys., 47,5248 (1976).

A known example of the MIM type electron-emitting devices is described by C. A. Mead, "Operation of Tunnel-Emission Devices", J. Appl. Phys., 32,646 (1961).

A known example of the SCE type electron-emitting devices is described by, e.g., M. I. Elinson, "Radio Eng. Electron Phys., 10, 1290 (1965) and other examples to be described later.

The SCE type electron-emitting device utilizes a phenomenon where an electron emission is produced in a small-area thin film, which has been formed on a substrate, by passing a current parallel to the film surface. As the SCE type electron-emitting device, electron-emitting devices using an Au thin film, an $In_2O_3/SnO_2$ thin film, a carbon thin film and the like are reported by G. Dittmer, "Thin solid Films", 9,317 (1972), M. Hartwell and C. G. Fonstad, "IEEE Trans. ED Conf.", 519 (1975), Hisashi Araki et al., "Vacuum", vol. 26, No. 1, p. 22 (1983), in addition to an $SnO_2$ thin film according to Elinson mentioned above.

FIG. 34 is a plan view of the SCE type electron-emitting device according to Hartwell and Fonstad described above, as a typical example of device construction of these SCE type electron-emitting devices. In FIG. 34, reference numeral 3001 denotes a substrate; 3004, a conductive thin film of a metal oxide formed by spattering, having a H-shaped pattern. An electron emission portion 3005 is formed by an electrification process referred to as "forming" to be described later. In FIG. 34, the interval L is set to 0.5–1 mm, and the width W is set to 0.1 mm. Note that the electron emission portion 3005 is shown at approximately the center of the conductive thin film 3004, with a rectangular shape. For the convenience of illustration, however, this does not exactly show the position and shape of the actual electron emission portion 3005.

In these conventional SCE type electron-emitting devices by M. Hartwell and the others, typically the electron emission portion 3005 is formed by performing electrification processing (referred to as "forming processing") on the conductive thin film 3004 before electron emission. According to the forming process, electrification is made by applying a constant direct current where voltage increases at a very slow rate of, e.g., 1V/min., to both ends of the conductive film 3004, so as to partially destroy or deform the conductive film 3004, thus form the electron emission portion 3005 with electrically high resistance. Note that the destroyed or deformed parts of the conductive thin film 3004 have a fissure. Upon application of appropriate voltage to the conductive thin film after the forming processing, electron emission is made near the fissures.

The above-described SCE type emitting devices are advantageous since they have a simple structure and they can be easily manufactured. Therefore many devices can be formed on a wide area. Then, as disclosed in Japanese Patent Application Laid-Open No. 64-31332 by the present applicant, a method for arranging and driving a lot of devices has been studied.

Regarding application of SCE type electron-emitting devices to, e.g., image forming apparatuses such as an image display apparatus and an image recording apparatus, and electron-beam sources have been studied.

Especially, as application to image display apparatuses, as shown in the U.S. Pat. No. 5,066,833 by the present applicant, an image display apparatus using the combination of a SCE type electron-emitting device and a fluorescent material which emits light upon reception of electronic beam has been studied. This type of image display apparatus is expected to have better characteristics than other conventional image display apparatuses. For example, in comparison with recently focused liquid crystal display apparatuses, the above display apparatus is superior in that it does not require a backlight since it is a self light-emitting type and that it has a wide view angle.

The present inventors have examined various SCE type electron-emitting devices having various structures, of various materials, according to various manufacturing methods. Further, the inventors have studied an electron-beam source where a large number of SCE type electron-emitting devices are arranged, and an image display apparatus utilizing the electron-beam source.

The inventors have also examined an electron-beam source by an electrical wiring method as shown in FIG. 31. The electron-beam source is constructed by arranging SCE type electron-emitting devices two-dimensionally, into a matrix.

In FIG. 31, numeral 4001 denotes SCE type electron-emitting devices; 4002, row-direction wiring; and 4003, column-direction wiring. The line-and column-direction wiring 4002 and 4003 actually have limited electric resistances. However, in FIG. 31, the electric resistances are indicated as wiring resistances 4004 and 4005. The wiring in FIG. 31 is referred to as "simple matrix wiring".

Note that in FIG. 31, the electron-beam source is shown with a 6×6 matrix for the convenience of illustration. However, the matrix size is not limited to this arrangement but may be any size as far as the matrix have devices of a number for a desired image display in case of, e.g., an electron-beam source for an image display apparatus.

In the electron-beam source having matrix-wired surface-conduction electron-emitting devices as shown in FIG. 31, to output a desired electron beam, appropriate electric signals are applied to the row- and column-direction wirings 4002 and 4003. For example, to drive SCE type electron-emitting devices in an arbitrary one line in the matrix, a selection voltage Vs is applied to the row-direction wiring 4002 at the line to be selected, at the same time, a non-selection voltage Vns is applied to the row-direction wiring 4002 at the lines not to be selected. In synchronization with this operation, a drive voltage Ve for outputting an electron beam is applied to the column-direction wiring 4003. According to this method, if voltage down by the wiring resistances 4004 and 4005 are ignored, the SCE type electron-emitting devices of the selected line receive a Ve−Vs voltage, while the SCE type electron-emitting devices of the non-selected lines receive a Ve−Vns voltage. If the voltages Ve, Vs and Vns are respectively set to an appropriate voltage value, an electron beam having a desired intensity is emitted only from the surface-conduction electron-emitting devices of the selected line. Further, if drive voltages Ve's of different values are applied to respective wire of the column-direction wiring 4003, electron beams of different intensities are emitted from the respective devices of the selected line. As the surface-conduction electron-emitting devices have a high response speed, an electron-beam emission period can be varied by changing an application period of applying the drive voltage Ve.

Thus, the electron-beam source having a simple-matrix wired SCE type electron-emitting devices provides various possibilities of application. For example, it can be used as an electron-beam source for an image display apparatus if appropriate application of an electric signal is made in accordance with image information.

However, the above electron-beam source actually has a problem as follows.

That is, regarding surface-conduction electron-emitting devices used in an image forming apparatus and the like, further increase of emission current and improvement of emission efficiency are desired. Note that "efficiency" means a current ratio of current emitted in vacuum (hereinafter referred to as "electron emission current Ie") with respect to current that flows when a voltage is applied to device electrode of each of surface-conduction electron-emitting devices (hereinafter referred to as "device current If").

SUMMARY OF THE INVENTION

Accordingly, an object of the present invention is to provide a processing method for increasing emission current of an electron-beam source having a plurality of electron-emitting devices.

Another object of the present invention is to provide a processing method for performing the above processing in a short period.

Another object of the present invention is to provide a processing method for uniforming emission current characteristics among a plurality of electron-emitting devices.

According to the present invention, the above objects are attined by providing an electron-beam source manufacturing method comprising an activation step of generating activation material at a plurality of electron-emitting devices, by dividing the plurality of electron-emitting devices into plural groups and sequentially applying voltages to each group.

Further, the present invention provides a method for manufacturing an image forming apparatus which comprises an image forming unit for forming an image by irradiation of electron beams from an electron-beam source having a plurality of electron-emitting devices, wherein the electron-beam source is manufactured in accordance with the above method.

Further, the present invention provides an electron-beam source activation method for activating an electron-beam source having a plurality of electron-emitting devices comprising an activation step of generating activation material at a plurality of electron-emitting devices, by dividing the plurality of electron-emitting devices into plural groups and sequentially applying voltages to each group.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

The present inventors have studied about the aforementioned increase of emission current amount, and found that increase of emission current Ie in vacuum is enabled by adding a new process referred to as "activation" processing (to be described in detail later) to control a film, comprising graphite or amorphous carbon or a mixture of both, and cover around an electron-emitting portion with the film.

Figure 27:
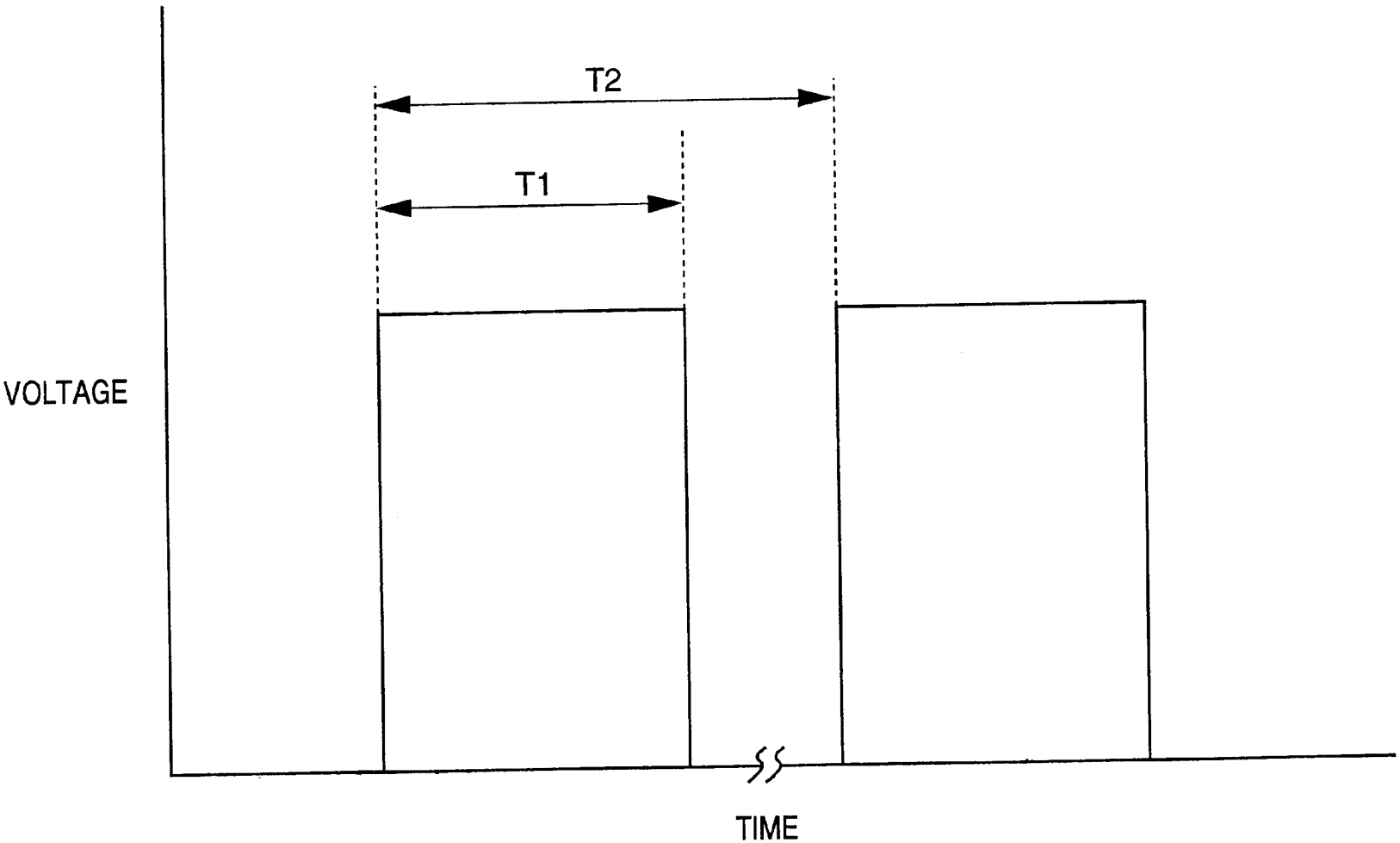
FIG. 27 is a graph showing a pulse-voltage waveform upon activation at a conventional SCE type electron-emitting device.
Figure 28:
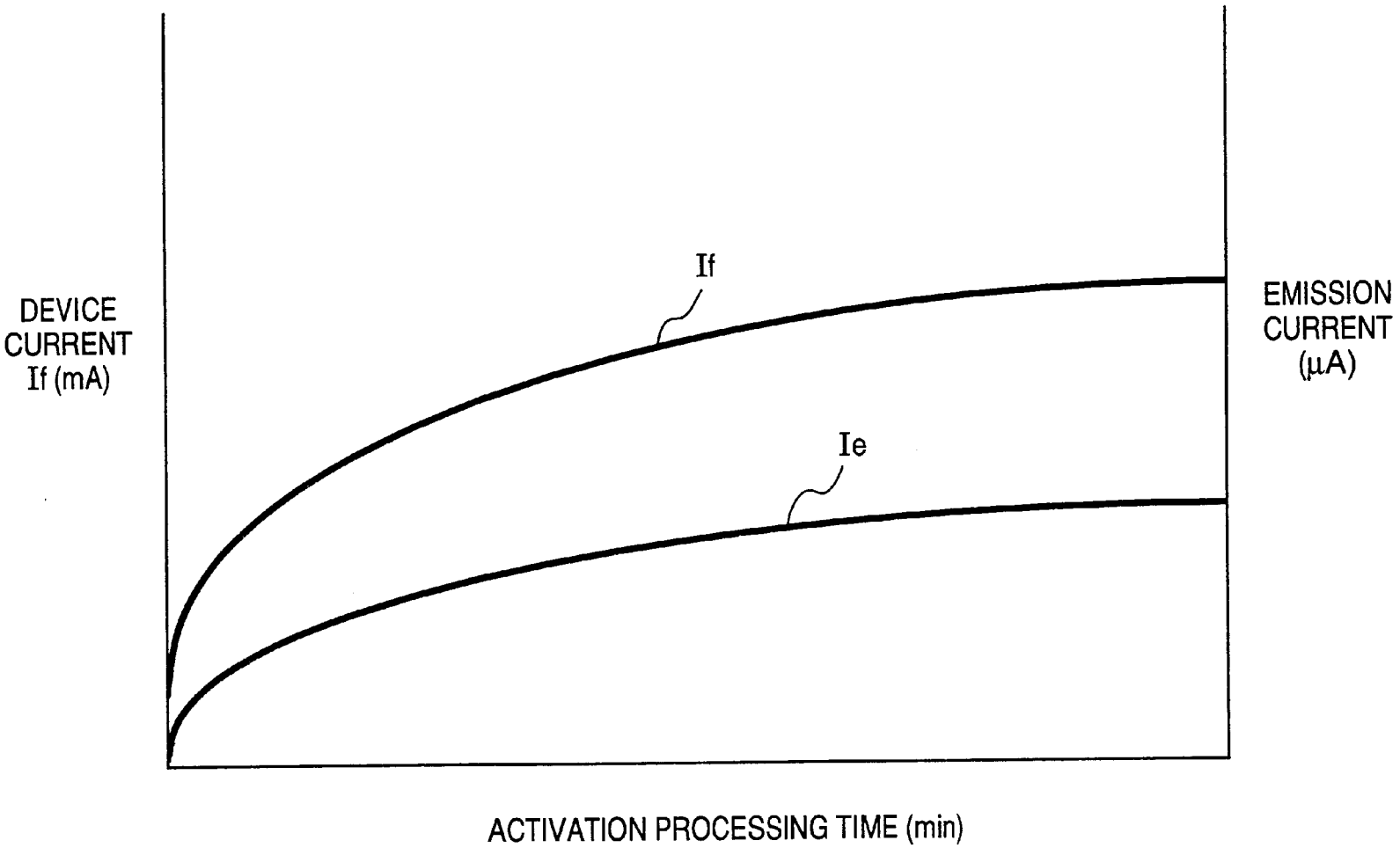
FIG. 28 is a line graph showing change of device current If and emission current Ie upon activation at the conventional SCE type electron-emitting device.

The activation processing is performed after the completion of the forming processing. In the activation processing, application of a pulse having a constant voltage in vacuum of $10^{-4}$–$10^{-5}$ Torr vacuum is repeated to accumulate the above carbon or carbon compound from organic material existing in the vacuum, which increases the emission current Ie to a considerably large amount. FIG. 27 shows an example of pulse-voltage waveform upon activation, and FIG. 28 shows an example of change of the device current If and the emission current Ie upon activation.

In this manner, addition of activation processing attains an increase of the emission current amount Ie of the SCE type electron-emitting device. In a case where this is applied to a method for manufacturing an electron-beam source having a simple-matrix wired SCE type electron-emitting devices, the following problems occur.

For example, when the activation processing is performed on an electron-beam source having N×M matrixed SCE type electron-emitting devices, (a) it takes a lot of time to complete processing of all the devices; and (b) non-uniformity occurs to an Ie-output characteristic of each SCE type electron-emitting device after processing.

Figure 29:
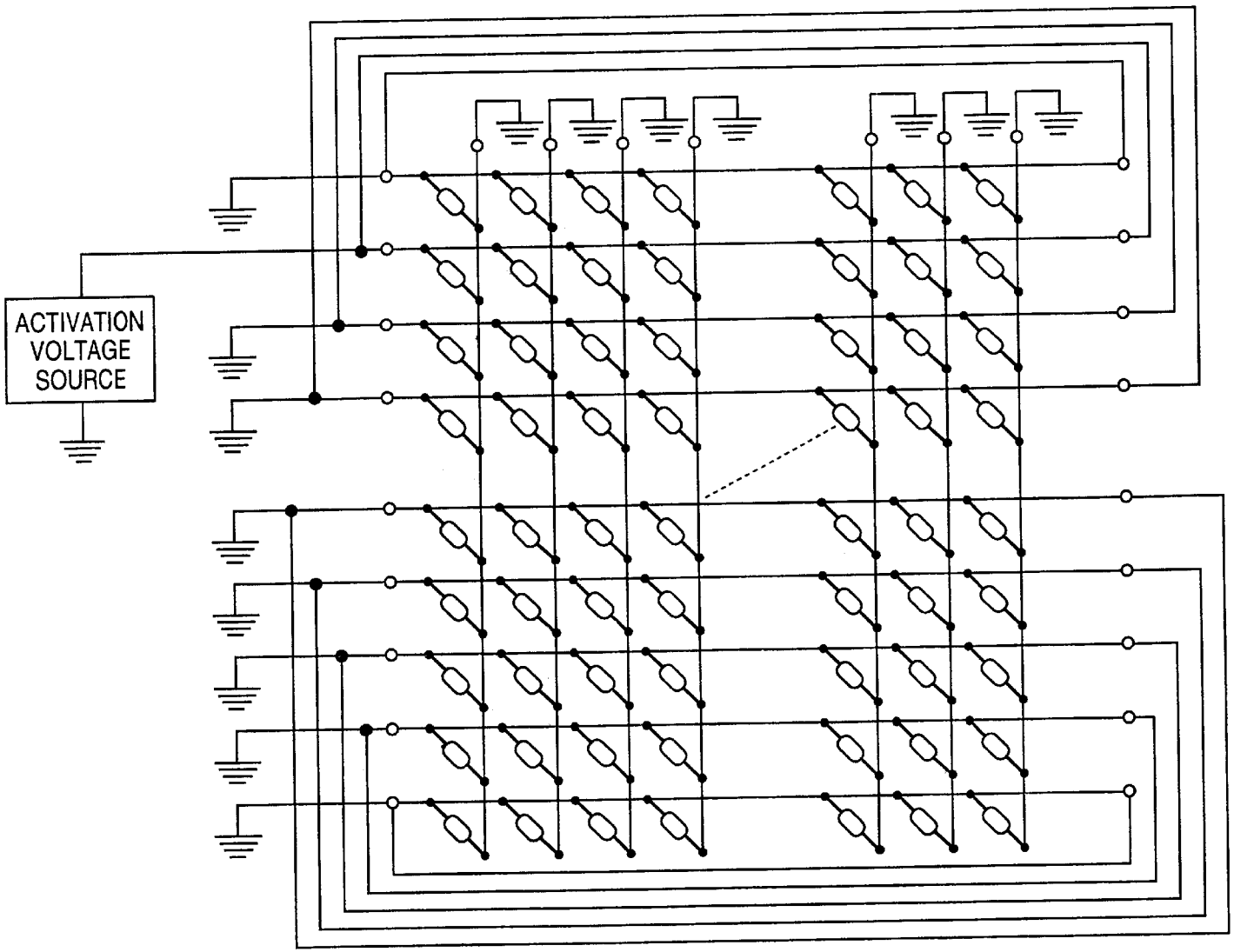
FIG. 29 is a plan view of an equivalence circuit upon activating a conventional simple-matrix wired SCE type electron-emitting device.
Figure 30:
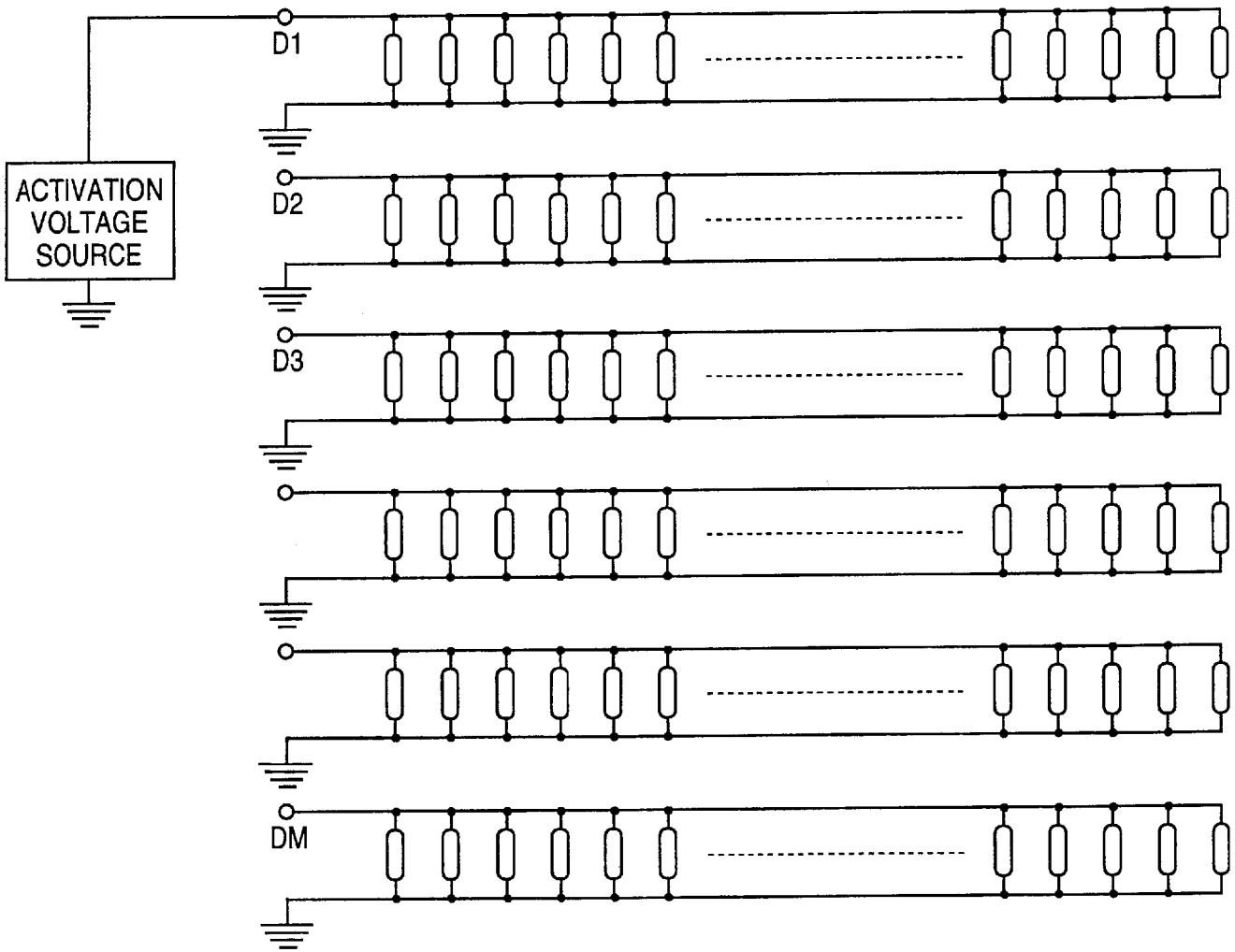
FIG. 30 is a plan view of an equivalence circuit upon activating a conventional ladder-wired SCE type electron-emitting device.

As the first problem that causes the above inconveniences, when the electron-beam source is manufactured, as 1st–Nth lines are sequentially activated, assuming it takes 30 minutes to perform the activation per line, 30×N minutes is necessary to complete the processing of the overall electron-beam source. FIG. 29 shows an equivalence circuit upon activation of the simple-matrix wired electron-beam source. In application of an image forming apparatuses such as a flat-type display, the number of N and that of M may be hundreds to thousands. Accordingly, a huge amount of activation time is necessary. In such case, manufacturing of an apparatus with low costs is difficult. Further, in long activation processing, as the amount of aforementioned organic materials in the vacuum changes, it is difficult to activate all the lines on a constant condition. In this case, uniformed electron-emitting characteristics cannot be obtained.

This problem also occurs in an electron-beam source where a plurality of SCE type electron-emitting devices are wired in a shape of a ladder (hereinafter referred to as "ladder wiring").

In this case, the activation requires time for the number of lines, and activation by line causes non-uniformity of electron-emitting characteristics of respective lines.

Figure 31:
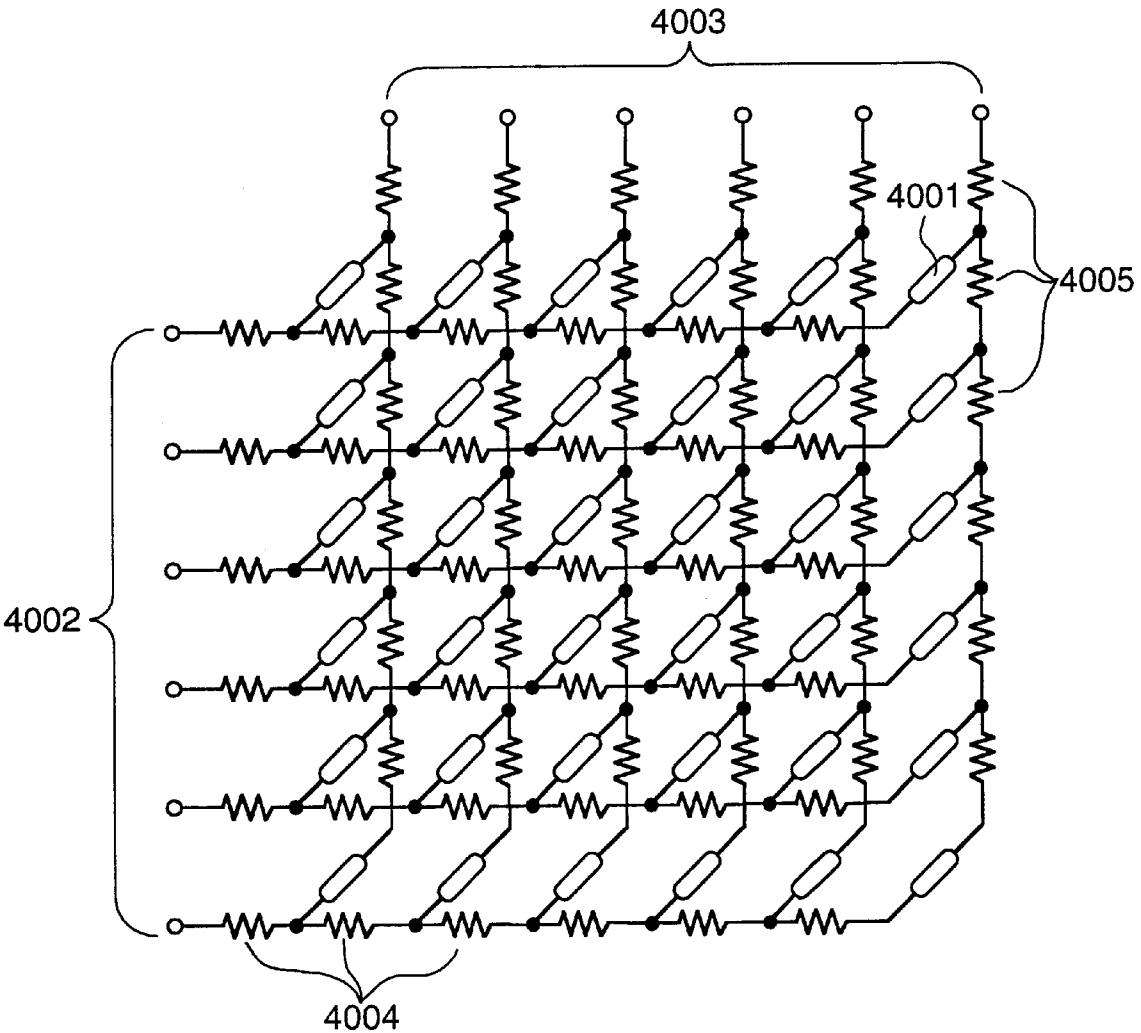
FIG. 31 is a plan view of a conventional electron device.

When the activation processing is performed on the multi-beam electron-beam source in FIG. 31 by line, i.e., when one wire of the row-direction wiring 4002 is selected, wiring resistances 4004 and 4005 of the row- and column-direction wirings cause voltage drop there. On the other hand, drive current from the column-direction wiring 4003 flows through the respective surface-conduction electron-emitting devices on the selected line of the row-direction wiring 4002. Accordingly, especially voltage drop at the row-direction wiring 4002 cannot be ignored, since this causes non-uniformity of the voltage applied to the surface-conduction electron-emitting devices connected to the selected wire of the row-direction wiring 4002 and difference among electron-emitting characteristics after the activation processing, which disturbs uniformed electron emission.

Figure 32:
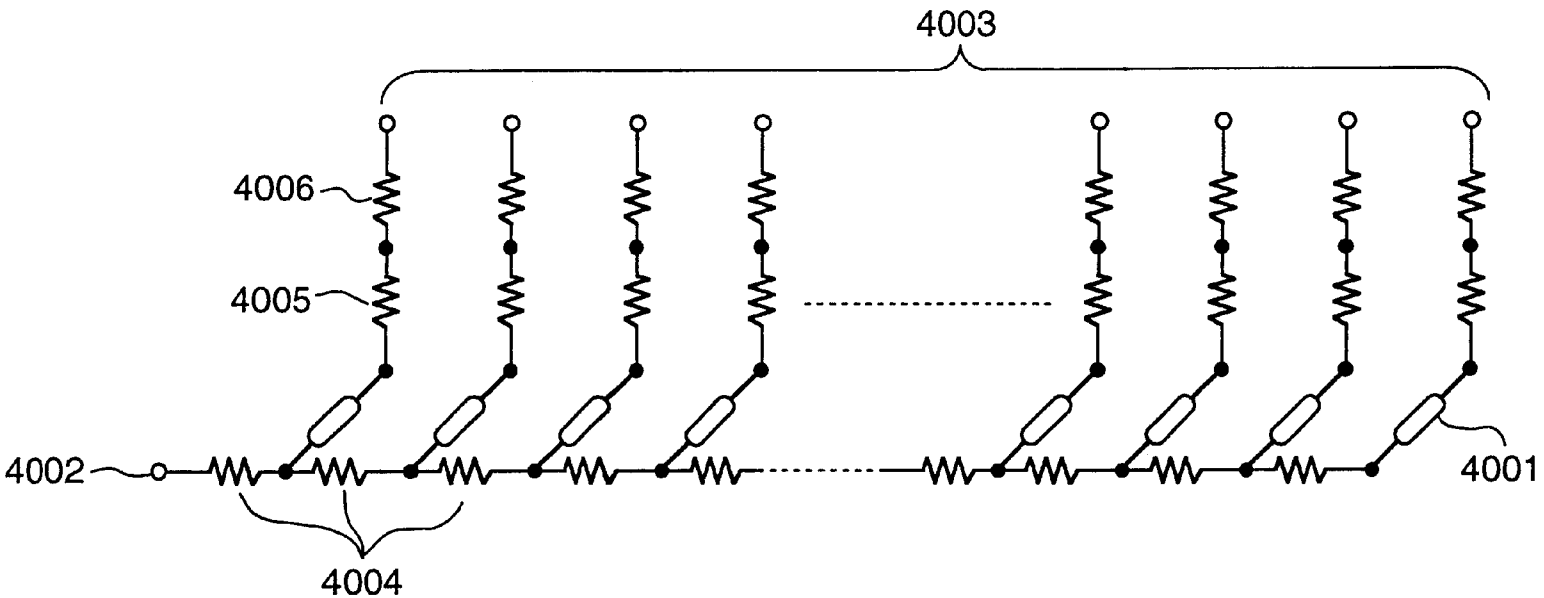
FIG. 32 is a plan view of an equivalence circuit using only devices on a selected and driven line.
Figure 33:
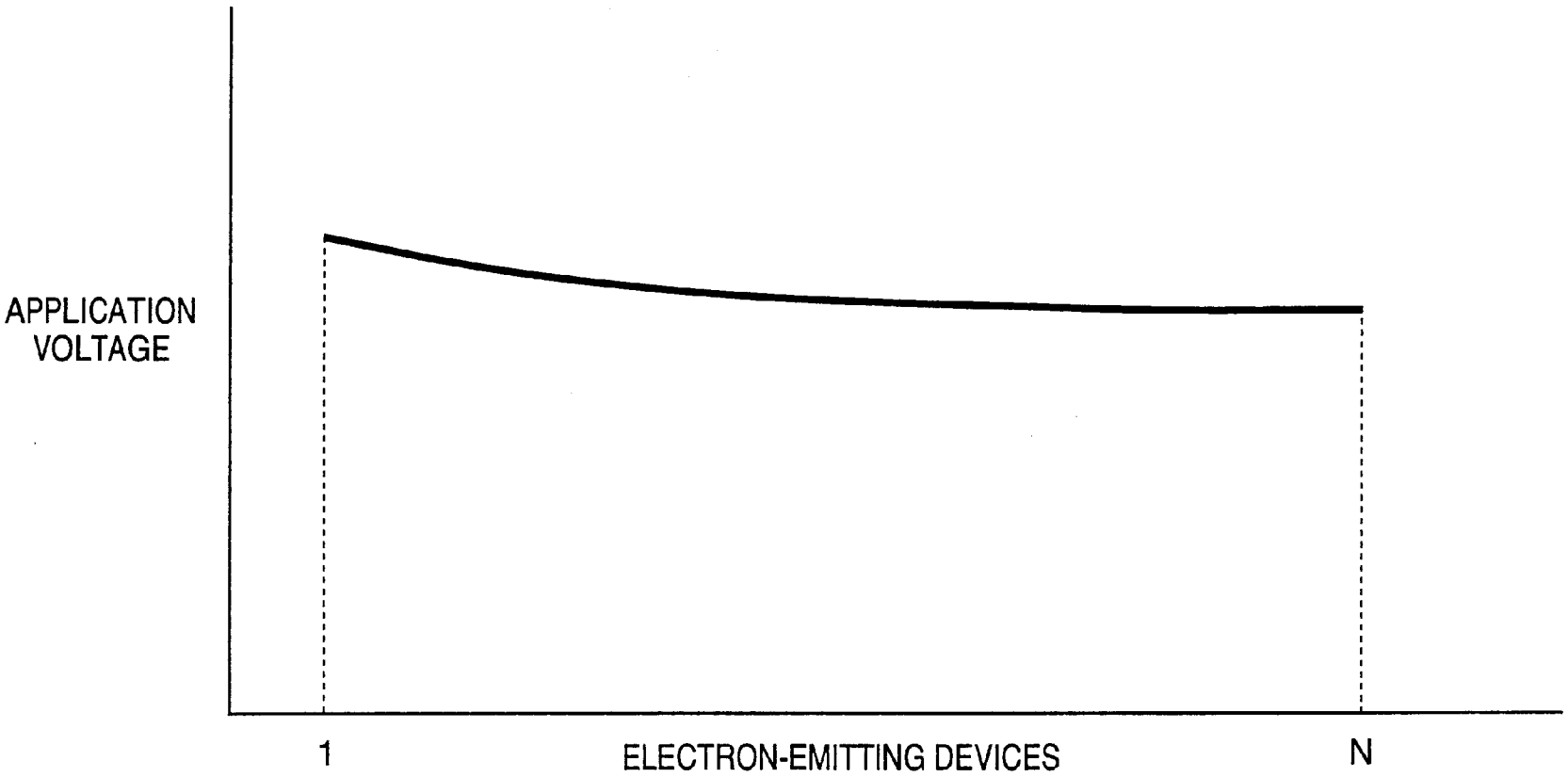
FIG. 33 is a graph showing application voltage to each device in electrification processing.
Figure 34:
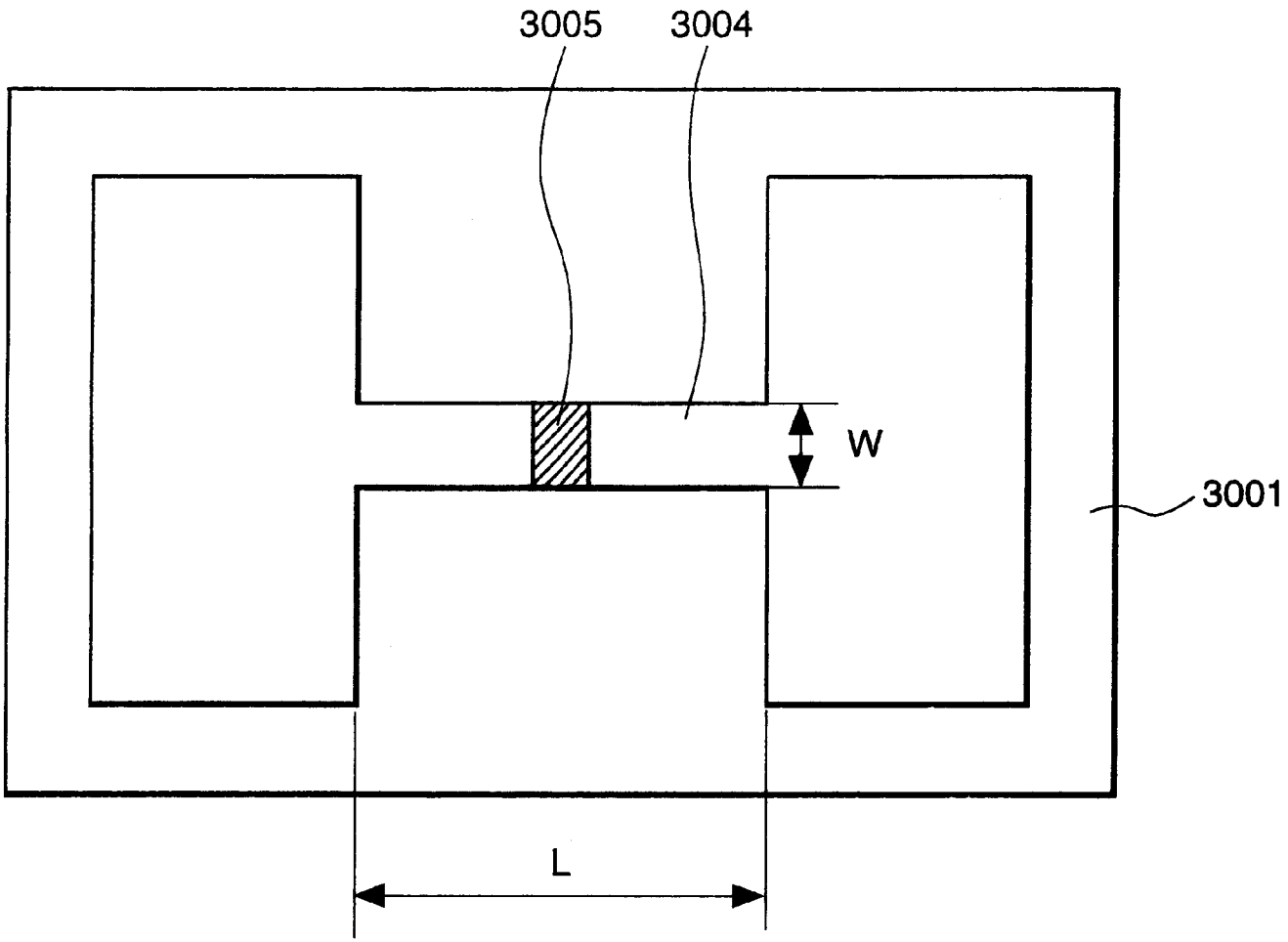
FIG. 34 is a plan view of a SCE type electron-emitting device by M.Hartwell and others.

Further, when the activation processing has progressed by a certain steps, the amount of resistance component of the SCE type electron-emitting device changes in two orders of magnitude due to the voltage applied to its both ends. That is, in status where the device is half selectively-driven in the simple matrix structure, the resistance component is large in comparison with completely selectively-driven status. Accordingly, the device half selectively-driven can be regarded as being open circuit. Then, the circuit of a multi electron-beam source having M×N matrixed SCE type electron-emitting devices shown in FIG. 3 can be shown with an equivalent circuit as shown in FIG. 32, where only selectively-driven 2devices are used. In FIG. 32, wiring resistance 4006 indicates accumulated resistance from driven end to a driven device, by each wire of column-direction wiring 4003. The drive current flows through the column-direction wiring 4003 to the respective devices, and branches of current get together on the row-direction wiring 4002. This causes voltage drop, as shown in FIG. 33, by the wiring resistance 4004 of the row-direction wiring 4002. As a result, difference occurs among the activation voltages applied to the respective devices, then difference occurs among electron-emitting characteristics of the respective devices. When such electron-beam source is employed for image display, uniformity of display luminance distribution is degraded.

The present invention has been made in view of the above findings and provides a method to deal with the first or second problem or both.

Preferred embodiments of the present invention will be described in detail below.

[General Embodiment]

A general embodiment of the present invention will be described in accordance with the attached drawings.

First, a SCE type electron-emitting device according to the embodiment, a multi electron-beam source formed using a plural number of the SCE type electron-emitting devices and an image display apparatus using the multi electron-beam source will be described with reference to FIGS. 8 to 18.

<Construction of Display Panel and Manufacturing Method >

First, the construction of a display panel of the image display apparatus to which the present invention is applied and a method for manufacturing the display panel will be described below.

Figure 8:
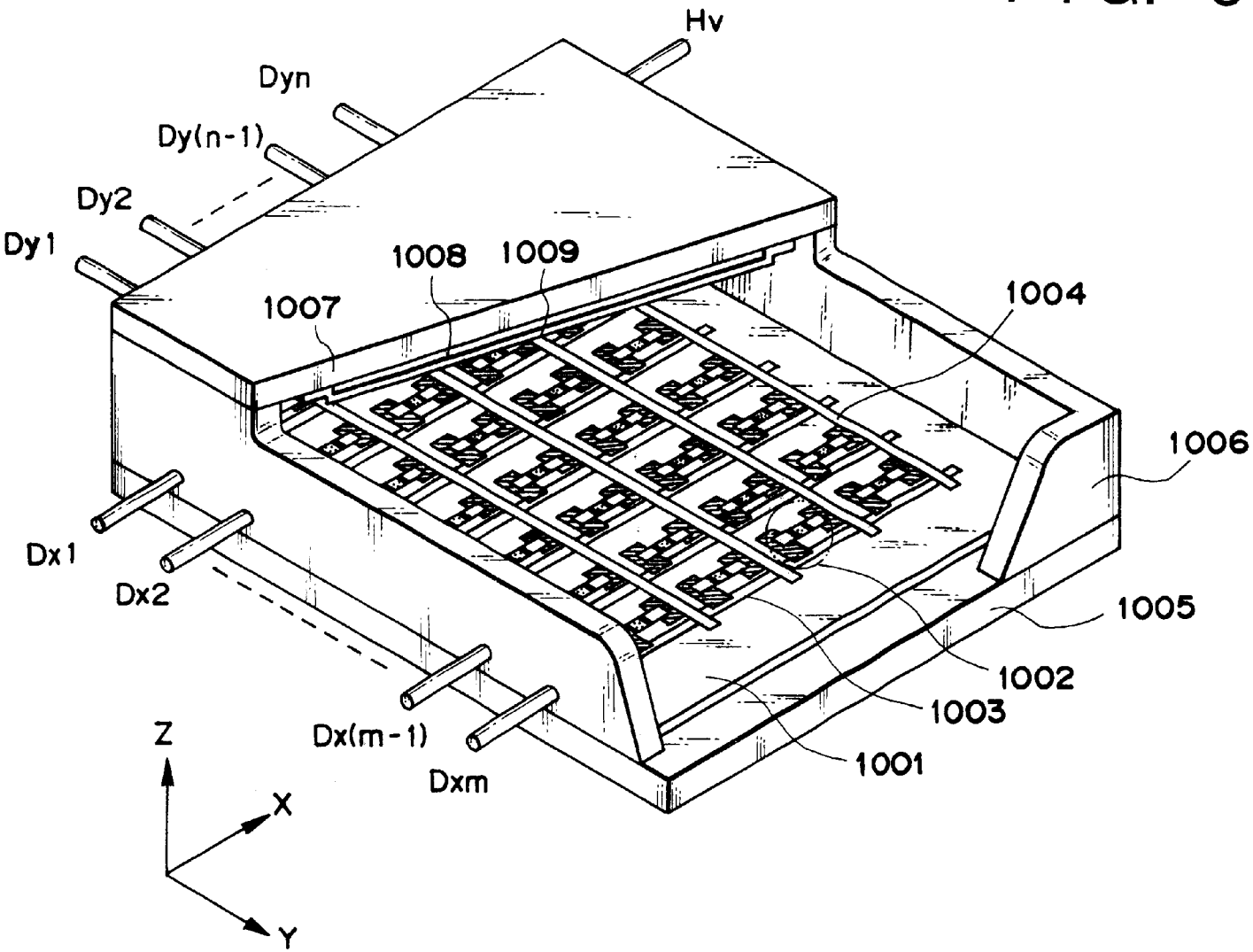
FIG. 8 is a perspective view of a display panel employed in the embodiments.

FIG. 8 is a perspective view of the display panel where a portion of the panel is removed for showing the internal structure of the panel.

In FIG. 8, numeral 1005 denotes a rear plate; 1006, a side wall; and 1007, a face plate. These parts form an airtight container for maintaining the inside of the display panel vacuum. To construct the airtight container, it is necessary to seal-connect the respective parts to obtain sufficient strength and maintain an airtight condition. For example, a frit glass is applied to junction portions, and sintered at 400 to 500° C. in air or nitrogen atmosphere, thus the parts are seal-connected. A method for exhausting air from the inside of the container will be described later.

The rear plate 1005 has a substrate 1001 fixed there, on which N×M SCE type electron-emitting devices 1002 are provided (M, N=positive integer equal to "2" or greater, appropriately set in accordance with an object number of display pixels. For example, in a display apparatus for high-quality television display, desirably N=3000 or greater, M=1000 or greater. In this embodiment, N=3072, M=1024). The N×M SCE type electron-emitting devices are arranged in a simple matrix with M row-direction wires (wiring 1003) and N column-direction wires (wiring 1004). The portion constituted with these parts (1001–1004) will be referred to as "multi electron-beam source". Note that a manufacturing method and the structure of the multi electron-beam source will be described in detail later.

In the general embodiment, the substrate 1001 of the multi electron-beam source is fixed to the rear plate 1005 of the airtight container. However, if the substrate 1001 has sufficient strength, the substrate 1001 of the multi electron-beam source itself may be used as the rear plate of the airtight container.

Figure 9A:
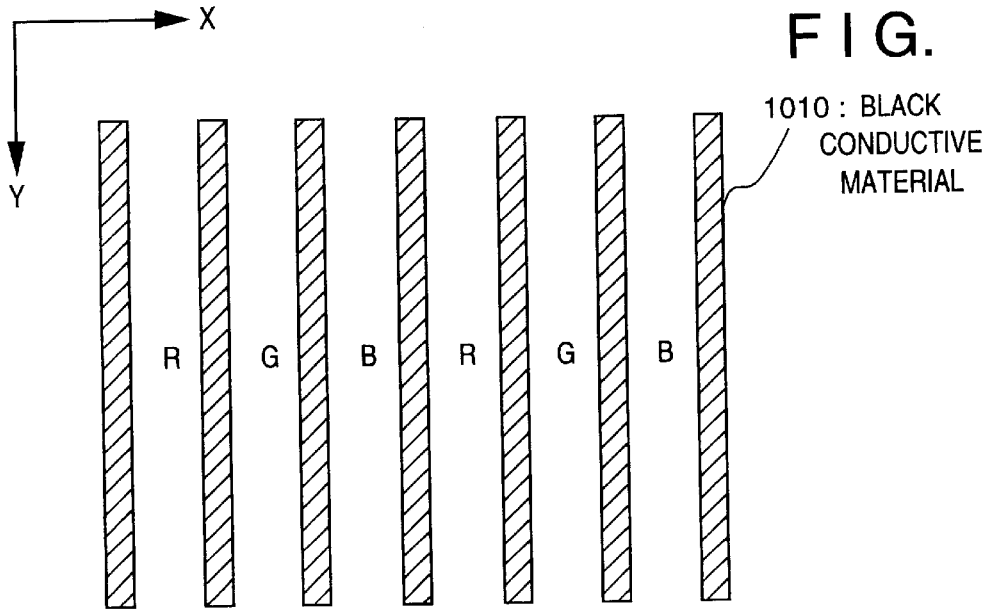
FIGS. 9A and 9B are explanatory views showing arrangement of fluorescent materials and black conductive material 1010 on a face plate of the display panel in FIG. 8.

Further, a fluorescent film 1008 is formed under the face plate 1007. As this embodiment is a color display apparatus, the fluorescent film 1008 is colored with red, green and blue three primary color fluorescent substances. The fluorescent substance portions are in stripes as shown in FIG. 9A, and black conductive material 1010 is provided between the stripes. The object of providing the black conductive material 1010 is to prevent shifting of display color even if the electron-beam irradiation position is shifted to some extent, to prevent degradation of display contrast by shutting off reflection of external light, to prevent charge-up of the fluorescent film by electron beams, and the like. The black conductive material 1010 mainly comprises graphite. However, any other materials may be employed so far as the above object can be attained.

Figure 9B:
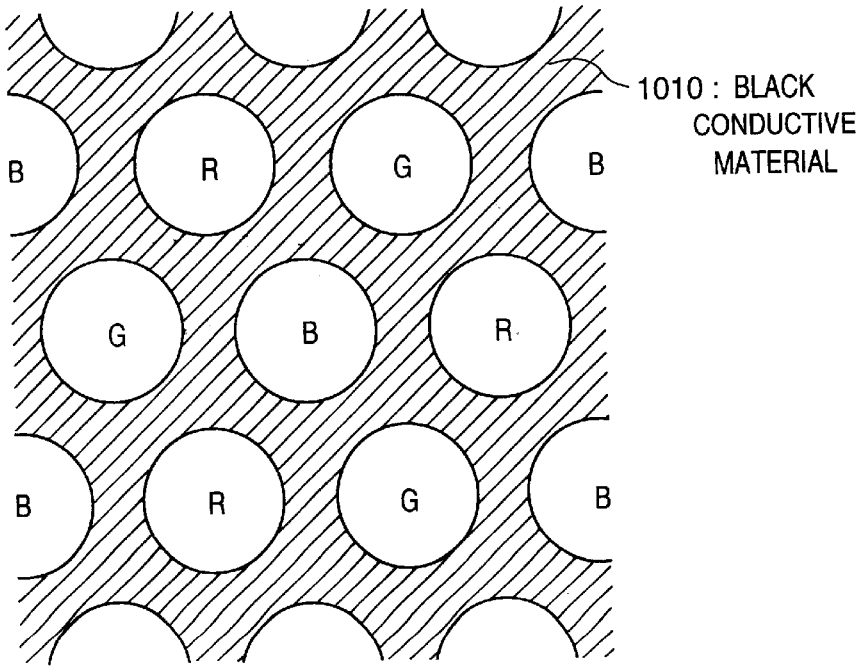

Further, three-primary colors of the fluorescent film is not limited to the stripes as shown in FIG. 9A. For example, delta arrangement as shown in FIG. 9B or any other arrangement may be employed. Note that when a monochrome display panel is formed, a single-color fluorescent substance may be applied to the fluorescent film 1008, and the black conductive material may be omitted.

Further, a metal back 1009, which is well-known in the CRT field, is provided on the rear plate side surface of the fluorescent film 1008. The object of providing the metal back 1009 is to improve light-utilization ratio by mirror-reflecting a part of light emitted from the fluorescent film 1008, to protect the fluorescent film 1008 from collision between negative ions, to use the metal back 1009 as an electrode for applying an electron-beam accelerating voltage, to use the metal back 1009 as a conductive path for electrons which excite the fluorescent film 1008, and the like. The metal back 1009 is formed by, after forming the fluorescent film 1008 on the face plate 1007, smoothing the fluorescent film front surface, and vacuum-evaporating Al thereon. Note that in a case where the fluorescent film 1008 comprises fluorescent material for low voltage, the metal back 1009 is not used.

Further, for application of accelerating voltage or improvement of conductivity of the fluorescent film, transparent electrodes may be provided between the face plate 1007 and the fluorescent film 1008, although the general embodiment does not employ such electrodes.

In FIG. 8, symbols Dx1 to Dxm, Dy1 to Dyn and Hv denote electric connection terminals for airtight structure provided for electrical connection of the display panel with an electric circuit (not shown). The terminals Dx1 to Dxm are electrically connected to the row-direction wiring 1003 of the multi electron-beam source; Dy1 to Dyn, to the column-direction wiring 1004; and Hv, to the metal back 1009 of the face plate.

To exhaust air from the inside of the airtight container and make the inside vacuum, after forming the airtight container, an exhaust pipe and a vacuum pump (both not shown) are connected, and exhaust air from the airtight container to vacuum at about $10^{-7}$ Torr. Thereafter, the exhaust pipe is sealed. To maintain vacuum conditions inside of the airtight container, a getter film (not shown) is constructed, immediately before/after the sealing. To maintain the vacuum condition inside of the airtight container, a getter film (not shown) is formed at a predetermined position in the airtight container. The gettering film is a film formed by heating and evaporating gettering material mainly including, e.g., Ba, by heating or high-frequency heating. The suction-attaching operation of the gettering film maintains the vacuum condition in the container $1\times10^{-5}$ or $1\times10^{-7}$ Torr.

The basis structure and manufacturing method of the display panel according to the general embodiment is described as above.

Next, the manufacturing method of the multi electron-beam source used in the display panel according to the general embodiment will be described. As the multi electron-beam source used in the image display apparatus, any manufacturing method may be employed so far as it is for manufacturing an electron-beam source where SCE type electron-emitting devices are arranged in a simple matrix. However, the present inventors has found that among the SCE type electron-emitting devices, an electron-beam source where an electron-emitting portion or its peripheral portion comprises a fine particle film is excellent in electron-emitting characteristic and further, it can be easily manufactured. Accordingly, this type of electron-beam source is the most appropriate electron-beam source to be employed in a multi electron-beam source of a high luminance and large-screened image display apparatus. In the display panel of the general embodiment, SCE type electron-emitting devices each has an electron-emitting portion or peripheral portion formed from a fine particle film are employed. First, the basic structure, manufacturing method and characteristic of the preferred SCE type electron-emitting device will be described, and the structure of the multi electron-beam source having simple-matrix wired SCE type electron-emitting devices will be described later.

<Preferred Structure and Manufacturing Method of SCE Device>

The typical structure of the SCE type electron-emitting device where an electron-emitting portion or its peripheral portion is formed from a fine particle film includes a flat type structure and a stepped type structure.

<<Flat SEC Type Electron-Emitting Device>>

Figure 10A:
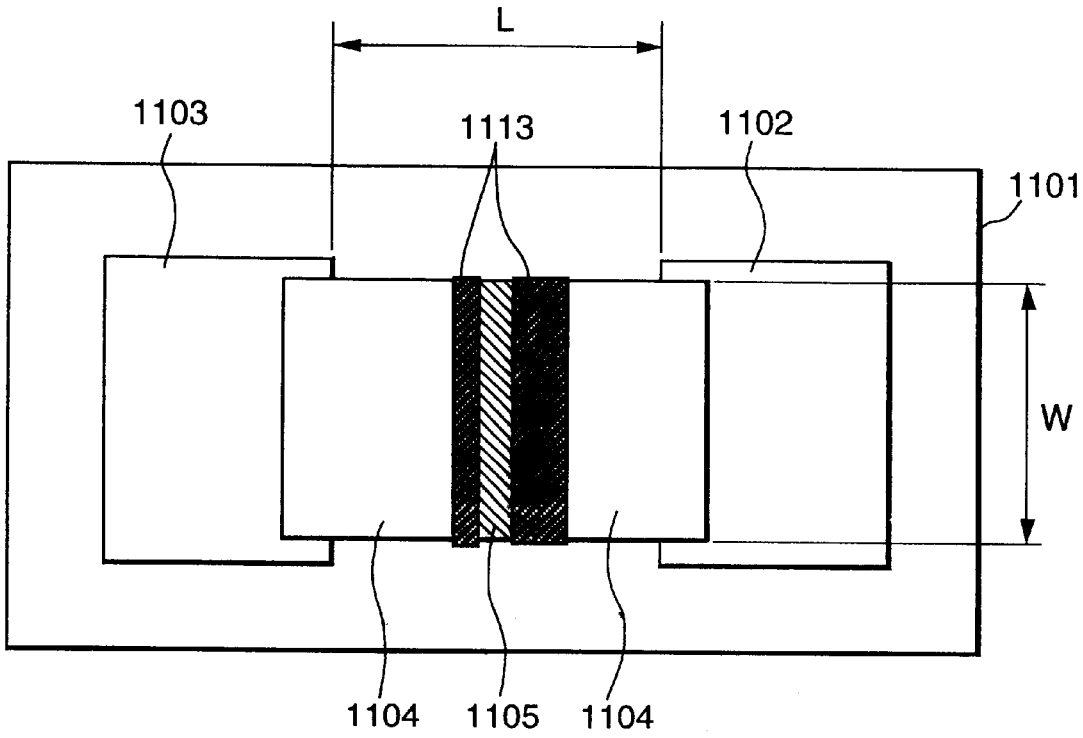
FIG. 10A is a plan view showing the structure of a flat SCE type electron-emitting device.
Figure 10B:
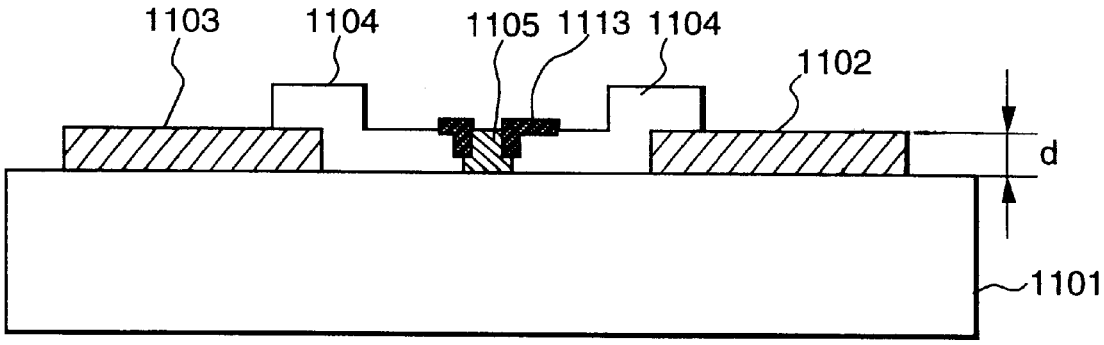
FIG. 10B is a cross-sectional view showing the structure of the flat SCE type electron-emitting device.

First, the structure and manufacturing method of a flat SCE type electron-emitting device will be described. FIG. 10A is a plan view explaining the structure of the flat SCE type electron-emitting device; and FIG. 10B, a cross-sectional view of the device. In FIGS. 10A and 10B, numeral 1101 denotes a substrate; 1102 and 1103, device electrodes; 1104, a conductive thin film; 1105, an electron-emitting portion formed by the forming processing; and 1113, a thin film formed by the activation processing.

As the substrate 1101, various glass substrates of, e.g., quartz glass and soda-lime glass, various ceramic substrates of, e.g., alumina, or any of those substrates with an insulating layer formed thereon can be employed.

The device electrodes 1102 and 1103, provided in parallel to the substrate 1101 and opposing to each other, comprise conductive material. For example, any material of metals such as Ni, Cr, Au, Mo, W, Pt, Ti, Cu, Pd and Ag, or alloys of these metals, otherwise metal oxides such as $In_2O_3$—$SnO_2$, or semiconductive material such as polysilicon, can be employed. The electrode is easily formed by the combination of a film-forming technique such as vacuum-evaporation and a patterning technique such as photolithography or etching. However, any other method (e.g., printing technique) may be employed.

The shape of the electrodes 1102 and 1103 is appropriately designed in accordance with an application object of the electron-emitting device. Generally, an interval L between electrodes is designed by selecting an appropriate value in a range from hundreds of angstroms to hundreds of micrometers. The most preferable range for a display apparatus is from several micrometers to tens of micrometers. As for electrode thickness d, an appropriate value is a range from hundreds of angstroms to several micrometers.

The conductive thin film 1104 comprises a fine particle film. The "fine particle film" is a film which contains a lot of fine particles (including masses of particles) as film-constituting members. In microscopic view, normally individual particles exist the film at predetermined intervals, or in adjacent to each other, or overlapped with each other.

One particle has a diameter within a range from several angstroms to thousands of angstroms. Preferably, the diameter is within a range from 10 angstroms to 200 angstroms. The thickness of the film is appropriately set in consideration of conditions as follows. That is, the condition necessary for electrical connection to the device electrode 1102 or 1103, the condition for the forming processing to be described later, the condition for setting electric resistance of the fine particle film itself to an appropriate value to be described later, etc.

Specifically, the thickness of the film is set in a range from several angstroms to thousands of angstroms, more preferably, 10 angstroms to 500 angstroms.

Materials used for forming the fine particle film are, e.g., metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, nitrides such as TiN, ZrN and HfN, semiconductors such as Si and Ge, and carbons. Any of appropriate material (s) is appropriately selected.

As described above, the conductive thin film 1104 is formed with a fine particle film, and sheet resistance of the film is set to reside within a range from $10^3$ to $10^7$ (Ω/sq).

As it is preferable that the conductive thin film 1104 is electrically connected to the device electrodes 1102 and 1103, they are arranged so as to overlap with each other at one portion. In FIG. 10B, the respective parts are overlapped in order of, the substrate, the device electrodes, and the conductive thin film, from the bottom. This overlapping order may be, the substrate, the conductive thin film, and the device electrodes, from the bottom.

The electron-emitting portion 1105 is a fissured portion formed at a part of the conductive thin film 1104. The electron-emitting portion 1105 has a resistance characteristic higher than the peripheral conductive thin film. The fissure is formed by the forming processing to be described later on the conductive thin film 1104. In some cases, particles, having a diameter of several angstroms to hundreds of angstroms, are arranged within the fissured portion. As it is difficult to exactly illustrate actual position and shape of the electron-emitting portion, FIGS. 10A and 10B show the fissured portion schematically.

The thin film 1113, which comprises carbon or carbon compound material, covers the electron-emitting portion 1115 and its peripheral portion. The thin film 1113 is formed by the activation processing to be described later after the forming processing.

The thin film 1113 is preferably graphite monocrystalline, graphite polycrystalline, amorphous carbon, or mixture thereof, and its thickness is 500 angstroms or less, more preferably, 300 angstroms or less.

As it is difficult to exactly illustrate actual position or shape of the thin film 1113, FIGS. 10A and 10B show the film schematically. FIG. 10A shows the device where a part of the thin film 1113 is removed.

The preferred basic structure of SCE type electron-emitting device is as described above. In the embodiment, the device has the following constituents.

That is, the substrate 1101 comprises a soda-lime glass, and the device electrodes 1102 and 1103, an Ni thin film.

The electrode thickness d is 1000 angstroms and the electrode interval L is 2 micrometers.

Next, a method of manufacturing a preferred flat SCE type electron-emitting device will be described with reference to FIGS. 11A to 11E which are cross-sectional views showing the manufacturing processes of the SCE type electron-emitting device. Note that reference numerals are the same as those in FIGS. 10A and 10B.

Figure 11A:
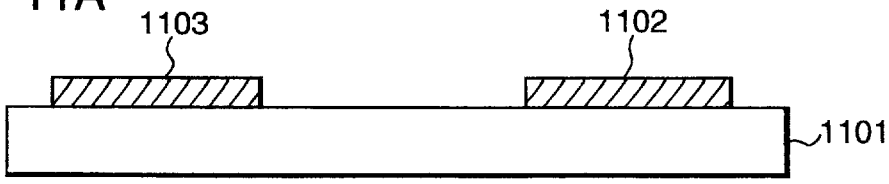
FIGS. 11A to 11E are schematic views explaining a manufacturing processes of the flat SCE type electron-emitting device in FIGS. 10A and 10B.

(1) First, as shown in FIG. 11A, the device electrodes 1102 and 1103 are formed on the substrate 1101.

Upon formation of the electrodes 1102 and 1103, first, the substrate 1101 is fully washed with a detergent, pure water and an organic solvent, then, material of the device electrodes is deposited there (as a depositing method, a vacuum film-forming technique such as evaporation and spattering may be used). Thereafter, patterning using a photolithography etching technique is performed on the deposited electrode material. Thus, the pair of device electrodes 1102 and 1103 are formed.

Figure 11B:
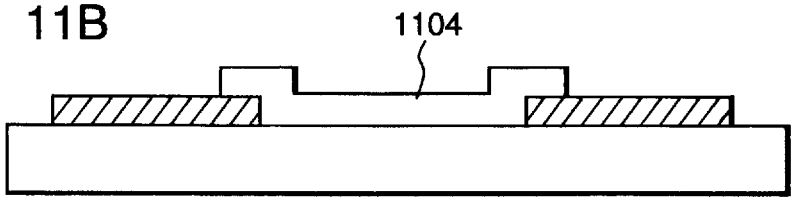

(2) Next, as shown in FIG. 11B, the conductive thin film 1104 is formed.

Upon formation of the conductive thin film 1104, first, an organic metal solvent is applied to the substrate 1101, then the applied solvent is dried and sintered, thus forming a fine particle film. Thereafter, the fine particle film is patterned, in accordance with the photolithography etching method, into a predetermined shape. The organic metal solvent means a solvent of organic metal compound containing material of minute particles, used for forming the conductive thin film, as the main component (i.e., Pd in this embodiment). In the embodiment, application of organic metal solvent is made by a dipping method, although any other method such as a spinner method and spraying method may be employed. As a film-forming method of the conductive thin film made with the minute particles, the application of organic metal solvent used in the embodiment can be replaced with any other method such as a vacuum evaporation method, a spattering method or a chemical vapor-phase accumulation method.

Figure 11C:
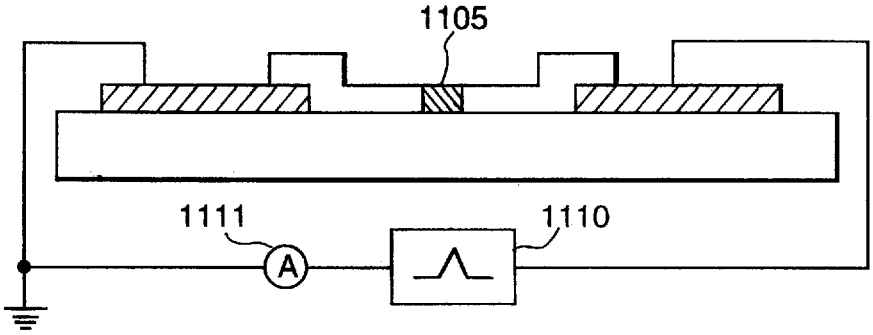

(3) Then, as shown in FIG. 11C, appropriate voltage is applied between the device electrodes 1102 and 1103, from a power source 1110 for the forming processing, then the forming processing is performed, thus forming the electron-emitting portion 1105.

The forming processing here is electric energization of a conductive thin film 1104 formed of a fine particle film, to appropriately destroy, deform, or deteriorate a part of the conductive thin film, thus changing the film to have a structure suitable for electron emission. In the conductive thin film, the portion changed for electron emission (i.e., electron-emitting portion 1105) has an appropriate fissure in the thin film. Comparing the thin film 1104 having the electron-emitting portion 1105 with the thin film before the forming processing, the electric resistance measured between the device electrodes 1102 and 1103 has greatly increased.

Figure 12:
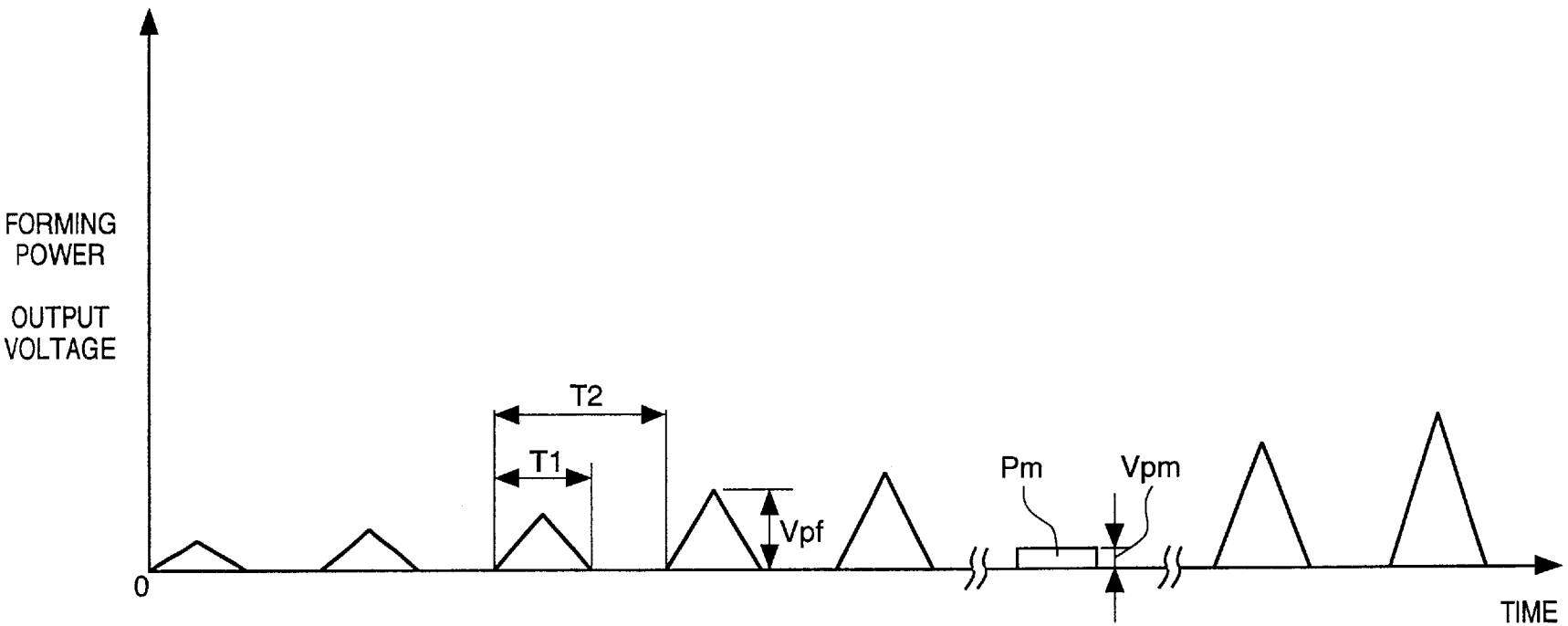
FIG. 12 is a line graph showing an example of a voltage waveform applied from a forming power source 1110.

The forming processing will be explained in detail with reference to FIG. 12 showing an example of waveform of appropriate voltage applied from the forming power source 1110. Preferably, in case of forming a conductive thin film of a fine particle film, a pulse-form voltage is employed. In this embodiment, a triangular-wave pulse having a pulse width T1 is continuously applied at pulse interval of T2. Upon application, a wave peak value Vpf of the triangular-wave pulse is sequentially increased. Further, a monitor pulse Pm to monitor status of forming the electron-emitting portion 1105 is inserted between the triangular-wave pulses at appropriate intervals, and current that flows at the insertion is measured by a galvanometer 1111.

In this example, in $10^{-5}$ Torr vacuum atmosphere, the pulse width T1 is set to 1 msec; and the pulse interval T2, to 10 msec. The wave peak value Vpf is increased by 0.1 V, at each pulse. Each time the triangular-wave has been applied for five pulses, the monitor pulse Pm is inserted. To avoid ill-effecting the forming processing, a voltage Vpm of the monitor pulse is set to 0.1 V. When the electric resistance between the device electrodes 1102 and 1103 becomes $1\times10^{6}\Omega$, i.e., the current measured by the galvanometer 1111 upon application of monitor pulse becomes $1\times10^{-7}\Omega$ or less, the electrification of the forming processing is terminated.

Note that the above processing method is preferable to the SCE type electron-emitting device of the present embodiment. In case of changing the design of the SCE type electron-emitting device concerning, e.g., the material or thickness of the fine particle film, or the device electrode interval L, the conditions for electrification are preferably changed in accordance with the change of device design.

Figure 11D:
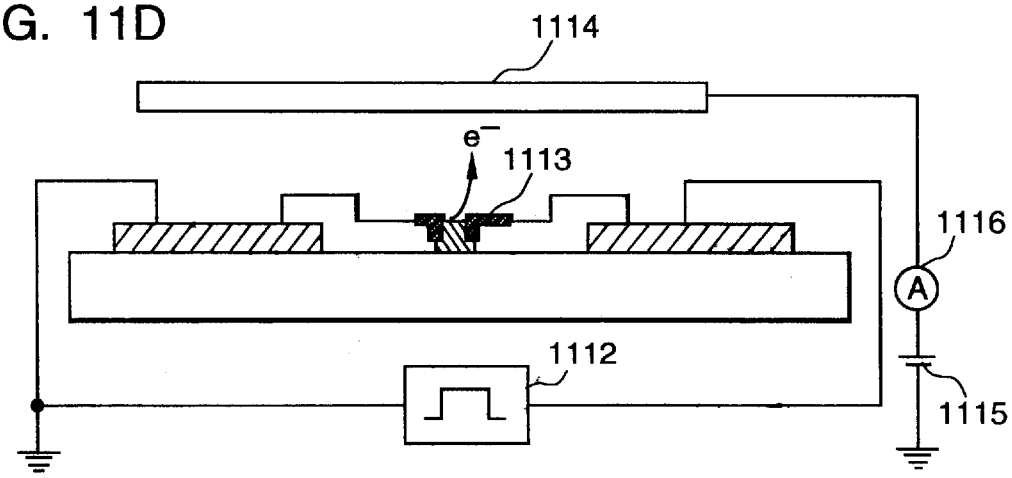

(4) Next, as shown in FIG. 11D, appropriate voltage is applied, from an activation power source 1112, between the device electrodes 1102 and 1103, and the activation processing is performed to improve electron-emitting characteristic.

The activation processing here is electrification of the electron-emitting portion 1105, formed by the forming processing, on appropriate condition(s), for depositing carbon or carbon compound around the electron-emitting portion 1105 (In FIG. 11D, the deposited material of carbon or carbon compound is shown as material 1113). Comparing the electron-emitting portion 1105 with that before the activation processing, the emission current at the same applied voltage has become typically 100 times or greater.

The activation is made by periodically applying a voltage pulse in $10^{-4}$ or $10^{-5}$ Torr vacuum atmosphere, to accumulate carbon or carbon compound mainly derived from organic compound(s) existing in the vacuum atmosphere. The accumulated material 1113 is any of graphite monocrystalline, graphite polycrystalline, amorphous carbon or mixture thereof. The thickness of the accumulated material 1113 is 500 angstroms or less, more preferably, 300 angstroms or less.

Figure 13A:
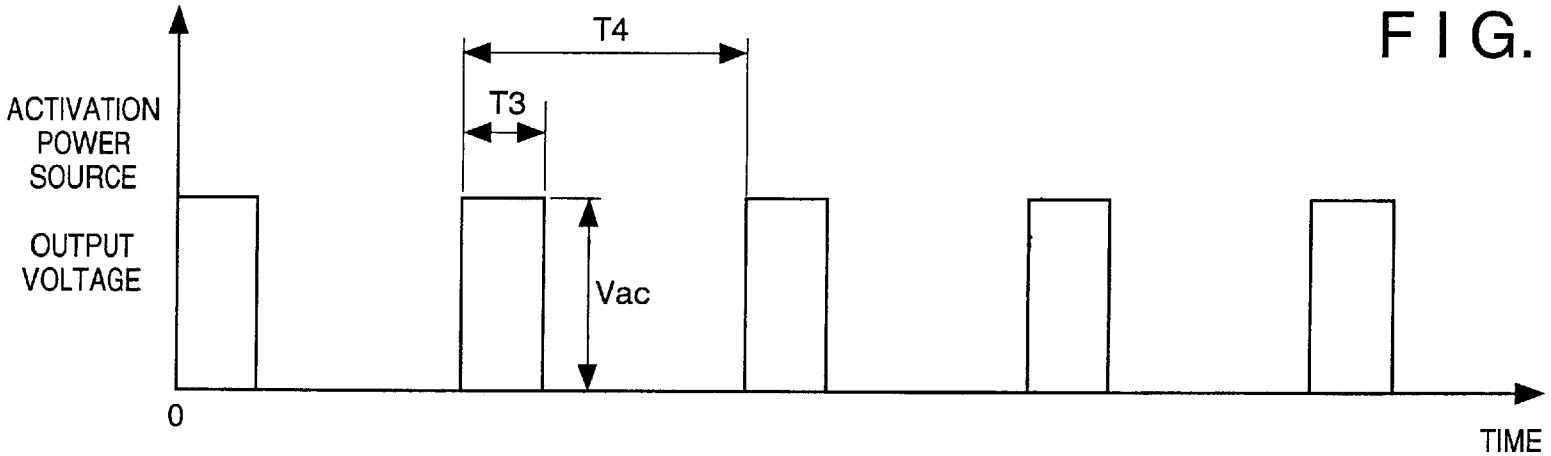
FIG. 13A is a histogram showing activation processing upon the flat SCE type electron-emitting device.

The activation processing will be described in more detail with reference to FIG. 13A showing an example of waveform of appropriate voltage applied from the activation power source 1112. In this example, a rectangular-wave voltage Vac is set to 14 V; a pulse width T3, to 1 msec; and a pulse interval T4, to 10 msec. Note that the above electrification conditions are preferable for the SCE type electron-emitting device of the embodiment. In a case where the design of the SCE type electron-emitting device is changed, the electrification conditions are preferably changed in accordance with the change of device design.

Figure 13B:
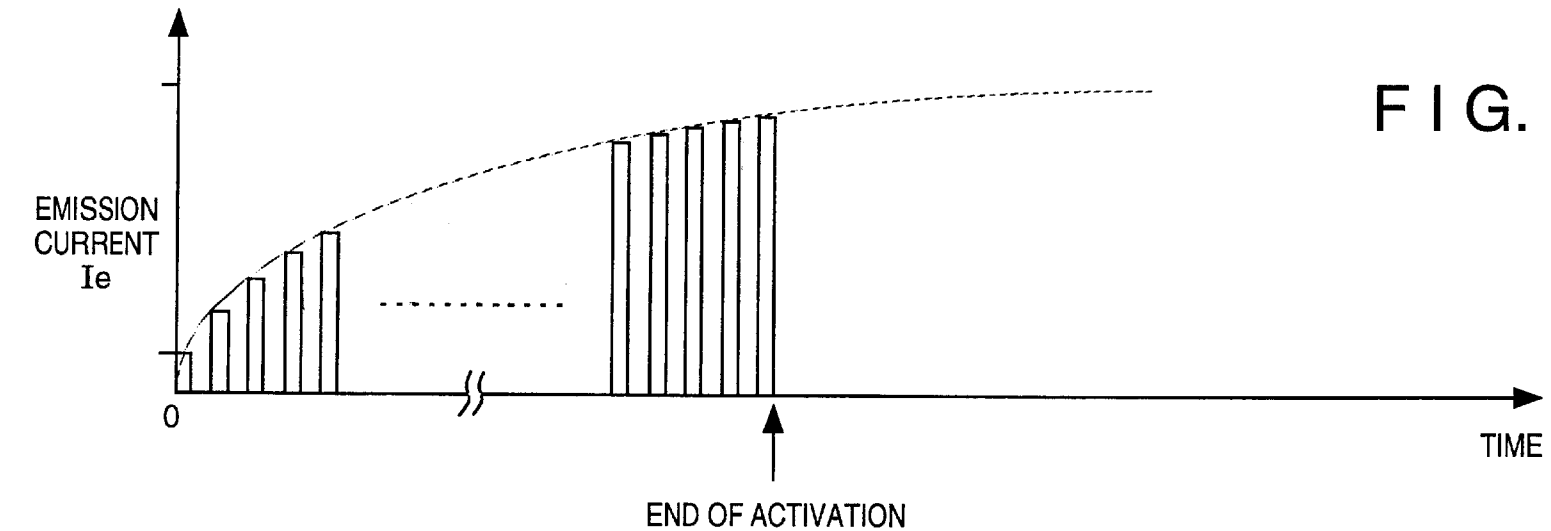
FIG. 13B is a histogram showing the activation processing upon a stepped SCE type electron-emitting device.

In FIG. 11D, numeral 1114 denotes an anode electrode, connected to a direct-current (DC) high-voltage power source 1115 and a galvanometer 1116, for capturing emission current Ie emitted from the SCE type electron-emitting device (in a case where the substrate 1101 is incorporated into the display panel before the activation processing, the Al layer on the fluorescent surface of the display panel is used as the anode electrode 1114). While applying voltage from the activation power source 1112, the galvanometer 1116 measures the emission current Ie, thus monitors the progress of activation processing, to control the operation of the activation power source 1112. FIG. 13B shows an example of the emission current Ie measured by the galvanometer 1116. In this example, as application of pulse voltage from the activation power source 1112 is started, the emission current Ie increases with elapse of time, gradually comes into saturation, and almost never increases then. At the substantial saturation point, the voltage application from the activation power source 1112 is stopped, then the activation processing is terminated.

Note that the above electrification conditions are preferable to the SCE type electron-emitting device of the embodiment. In case of changing the design of the SCE type electron-emitting device, the conditions are preferably changed in accordance with the change of device design.

Figure 11E:
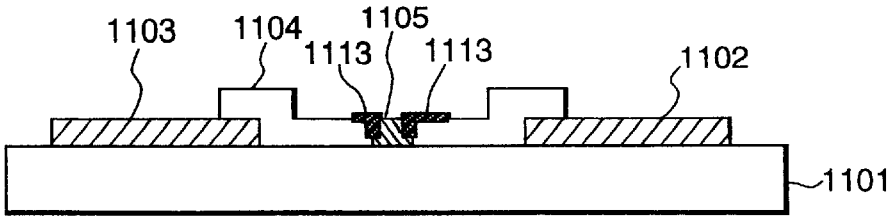

As described above, the SCE type electron-emitting device as shown in FIG. 11E is manufactured.

<<Step SCE type Electron-Emitting Device>>

Next, another typical structure of the SCE type electron-emitting device where an electron-emitting portion or its peripheral portion is formed of a fine particle film, i.e., a stepped SCE type electron-emitting device will be described.

Figure 14:
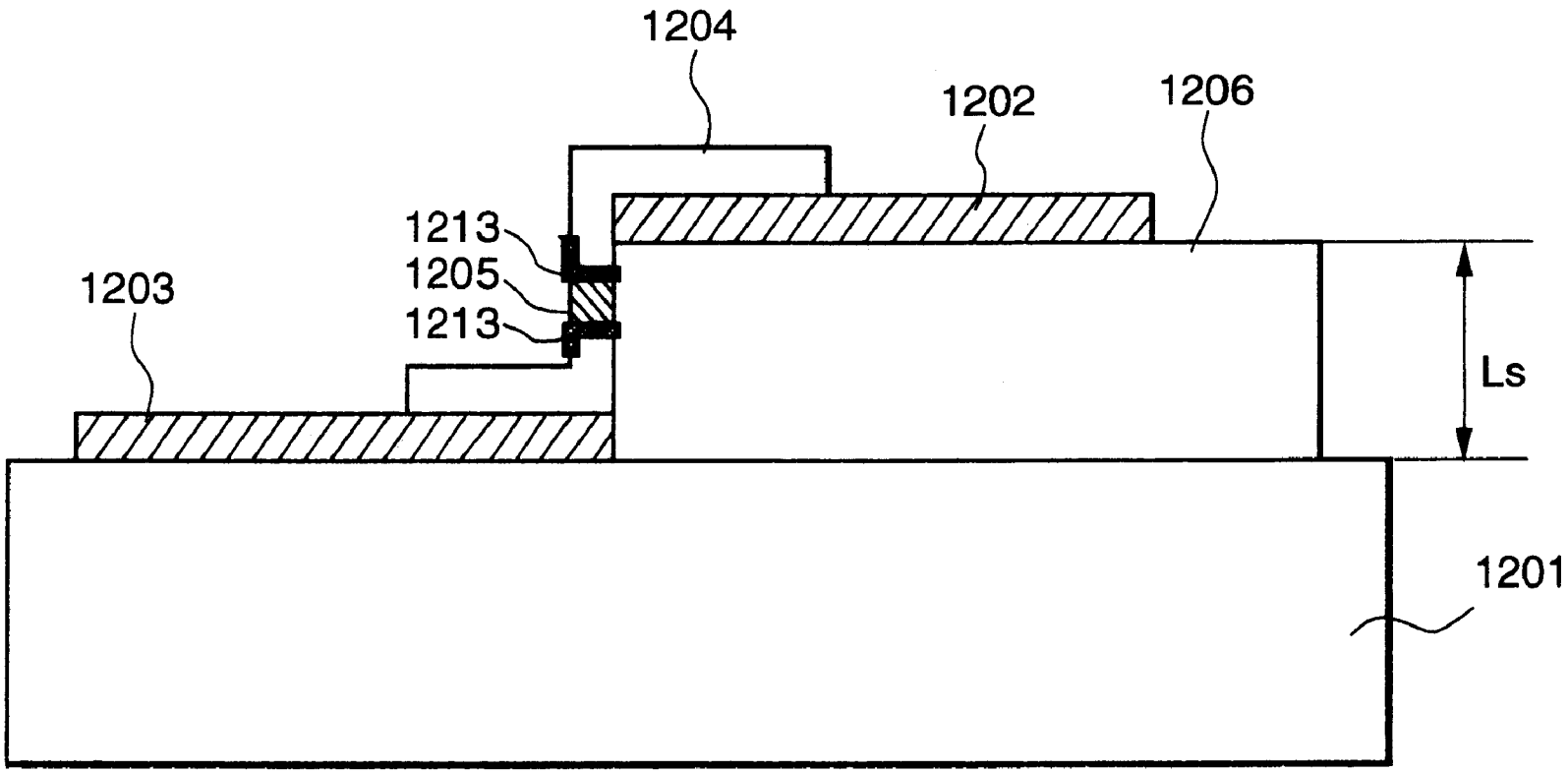
FIG. 14 is a cross-sectional view of a typical structure of the stepped SCE type electron-emitting device.

FIG. 14 is a cross-sectional view schematically showing the basic construction of the step SCE type electron-emitting device. In FIG. 14, numeral 1201 denotes a substrate; 1202 and 1203, device electrodes; 1206, a step-forming member for making height difference between the electrodes 1202 and 1203; 1204, a conductive thin film using a fine particle film; 1205, an electron-emitting portion formed by the forming processing; and 1213, a thin film formed by the activation processing.

The difference from the step device structure from the above-described flat device structure is that one of the device electrodes (1202 in this example) is provided on the step-forming member 1206 and the conductive thin film 1204 covers the side surface of the step-forming member 1206. The device interval L in FIGS. 10A and 10B is set in this structure as a height difference Ls corresponding to the height of the step-forming member 1206. Note that the substrate 1201, the device electrodes 1202 and 1203, the conductive thin film using the fine particle film can comprise the materials given in the explanation of the flat SCE type electron-emitting device. Further, the step-forming member 1206 comprises electrically insulating material such as $SiO_2$.

Next, a method of manufacturing the stepped SCE type electron-emitting device will be described with reference FIGS. 15A to 15F which are cross-sectional views showing the manufacturing processes. In these figures, reference numerals of the respective parts are the same as those in FIG. 14.

Figure 15A:
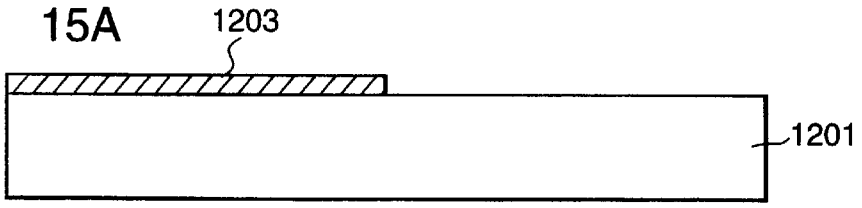
FIGS. 15A to 15F are explanatory views showing manufacturing processes of the stepped SCE type electron-emitting device in FIG. 14.

(1) First, as shown in FIG. 15A, the device electrode 1203 is formed on the substrate 1201.

Figure 15B:
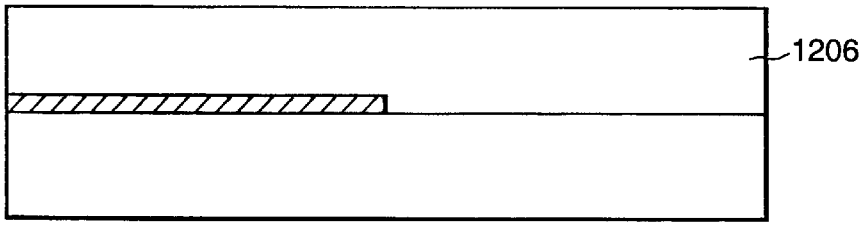

(2) Next, as shown in FIG. 15B, an insulating layer for forming the step-forming member 1206 is deposited. The insulating layer may be formed by accumulating, e.g., $SiO_2$ by a spattering method, although, the insulating layer may be formed by a film-forming method such as a vacuum evaporation method or a printing method.

Figure 15C:
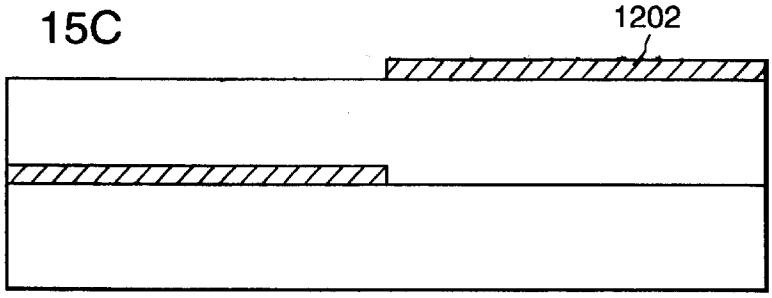

(3) Next, as shown in FIG. 15C, the device electrode 1202 is formed on the insulating layer.

Figure 15D:
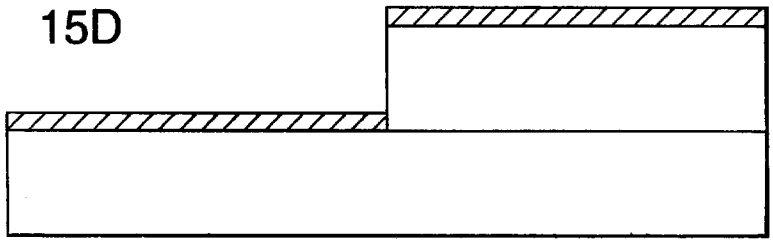

(4) Next, as shown in FIG. 15D, a part of the insulating layer is removed by using, e.g., an etching method, to expose the device electrode 1203.

Figure 15E:
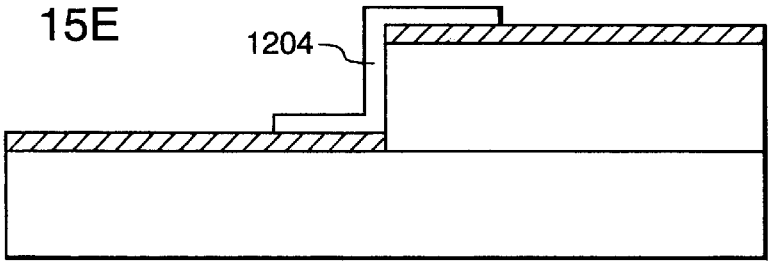
Figure 15F:
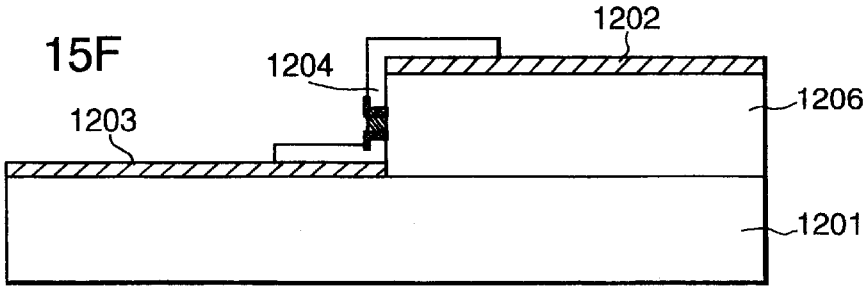

(5) Next, as shown in FIG. 15E, the conductive thin film 1204 using the fine particle film is formed. Upon formation, similar to the above-described flat device structure, a film-forming technique such as an applying method is used.

(6) Next, similar to the flat device structure, the forming processing is performed to form the electron-emitting portion 1205 (the forming processing similar to that explained using FIG. 11C may be performed).

(7) Next, similar to the flat device structure, the activation processing is performed to deposit carbon or carbon compound around the electron-emitting portion (activation processing similar to that explained using FIG. 11D may be performed).

As described above, the stepped SCE type electron-emitting device is manufactured.

<Characteristic of SCE Type Electron-Emitting Device used in Display Apparatus>

The structure and manufacturing method of the flat SCE type electron-emitting device and those of the stepped SCE type electron-emitting device are as described above. Next, the characteristic of the electron-emitting device used in the display apparatus will be described below.

Figure 16:
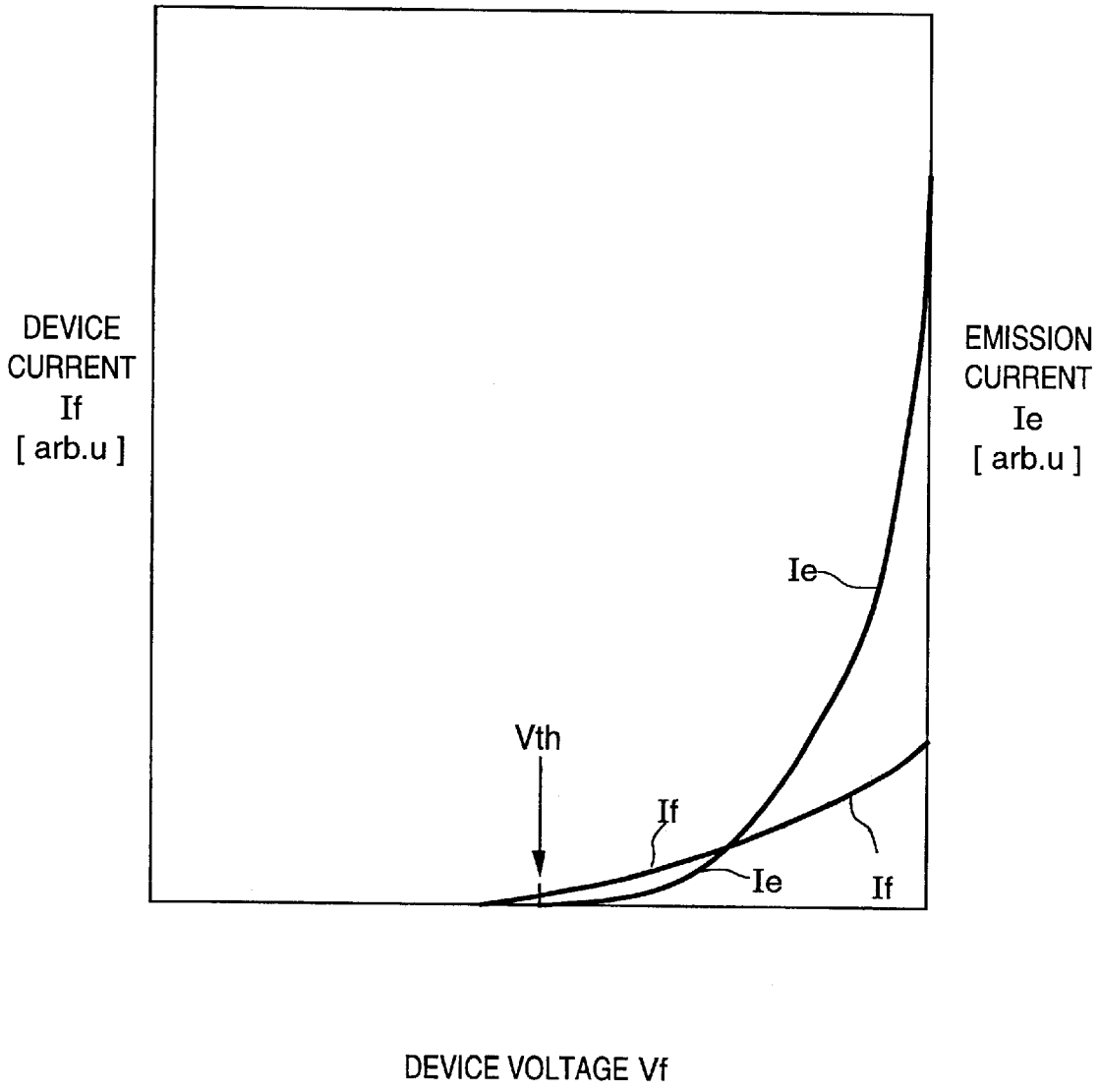
FIG. 16 is a line graph showing a typical example of (emission current Ie) to (device application voltage Vf) characteristic and (device current If) to (device application voltage Vf) characteristic of the device used in a display apparatus.

FIG. 16 shows a typical example of (emission current Ie) to (device voltage (i.e. voltage to be applied to the device) Vf) characteristic and (device current If) to (device application voltage Vf) characteristic of the device used in the display apparatus. Note that compared with the device current If, the emission current Ie is very small, therefore it is difficult to illustrate the emission current Ie by the same measure of that for the device current If. In addition, these characteristics change due to change of designing parameters such as the size or shape of the device. For these reasons, two lines in the graph of FIG. 16 are respectively given in arbitrary units.

Regarding the emission current Ie, the device used in the display apparatus has three characteristics as follows:

(1) When voltage of a predetermined level (referred to as "threshold voltage Vth") or greater is applied to the device, the emission current Ie drastically increases. However, with voltage lower than the threshold voltage Vth, almost no emission current Ie is detected. That is, regarding the emission current Ie, the device has a non-linear characteristic based on the clear threshold voltage Vth.

(2) The emission current Ie changes in dependence upon the device application voltage Vf. Accordingly, the emission current Ie can be controlled by changing the device voltage Vf.

(3) The emission current Ie is outputted quickly in response to application of the device voltage Vf. Accordingly, an electrical charge amount of electrons to be emitted from the device can be controlled by changing period of application of the device voltage Vf.

The SCE type electron-emitting device with the above three characteristics is preferably applied to the display apparatus. For example, in a display apparatus having a large number of devices provided corresponding to the number of pixels of a display screen, if the first characteristic is utilized, display by sequential scanning of display screen is possible. This means that the threshold voltage Vth or greater is appropriately applied to a driven device, while voltage lower than the threshold voltage Vth is applied to an unselected device. In this manner, sequentially changing the driven devices enables display by sequential scanning of display screen.

Further, emission luminance can be controlled by utilizing the second or third characteristic, which enables multi-gradation display.

<Structure of Simple-Matrix Wired Multi Electron-Beam source>

Next, the structure of a multi electron-beam source where a large number of the above SCE type electron-emitting devices are arranged with the simple-matrix wiring will be described below.

Figure 17:
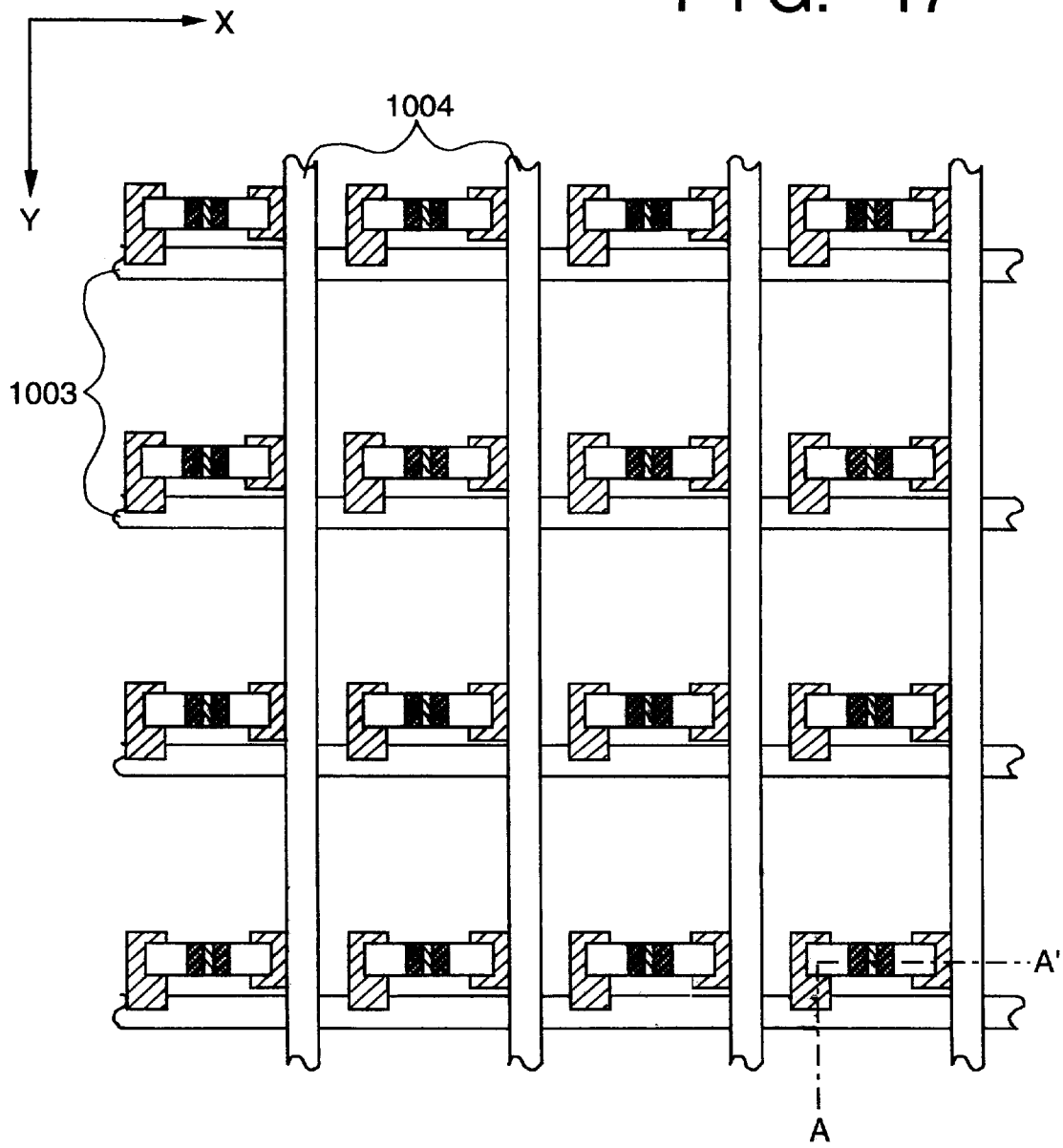
FIG. 17 is a plan view of a multi electron-beam source applied to the display panel in FIG. 8.

FIG. 17 is a plan view of the multi electron-beam source used in the display panel in FIG. 8. There are SCE type electron-emitting devices similar to those shown in FIGS. 10A and 10B on the substrate. These devices are arranged in a simple matrix with the row-direction wiring 1003 and the column-direction wiring 1004. At an intersection of the wirings 1003 and 1004, an insulating layer (not shown) is formed between the wires, to maintain electrical insulation.

Figure 18:
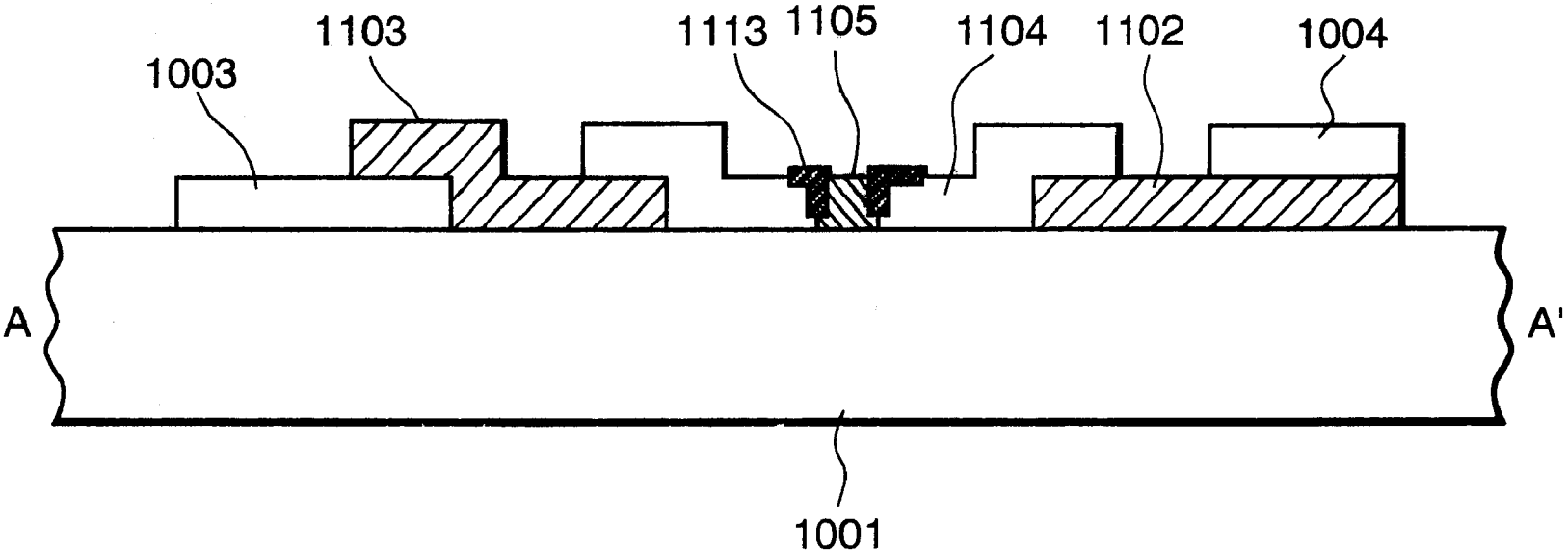
FIG. 18 is a cross-sectional view cut out at A–A' lines of the multi electron-beam source in FIG. 17.

FIG. 18 shows a cross-section cut out along the line A–A' in FIG. 17.

Note that this type of multi electron-beam source is manufactured by forming the row- and column-direction wirings 1003 and 1004, the insulating layers (not shown) at wires' intersections, the device electrodes and conductive thin films on the substrate, then supplying electricity to the respective devices via the row- and column-direction wirings 1003 and 1004, thus performing the forming processing and the activation processing.

As described above, in the manufacturing processes of the multi electron-beam source using the SCE type electron-emitting devices, the activation processing have a great influence upon display characteristic of formed image display apparatus. Although the description has been made with regard to one device, however, in formation of the image display apparatus, the activation processing is required to all the devices. The following first to eighth embodiments are examples of preferred activation processing to the entire multi electron-beam source.

[First Embodiment]

Figure 1:
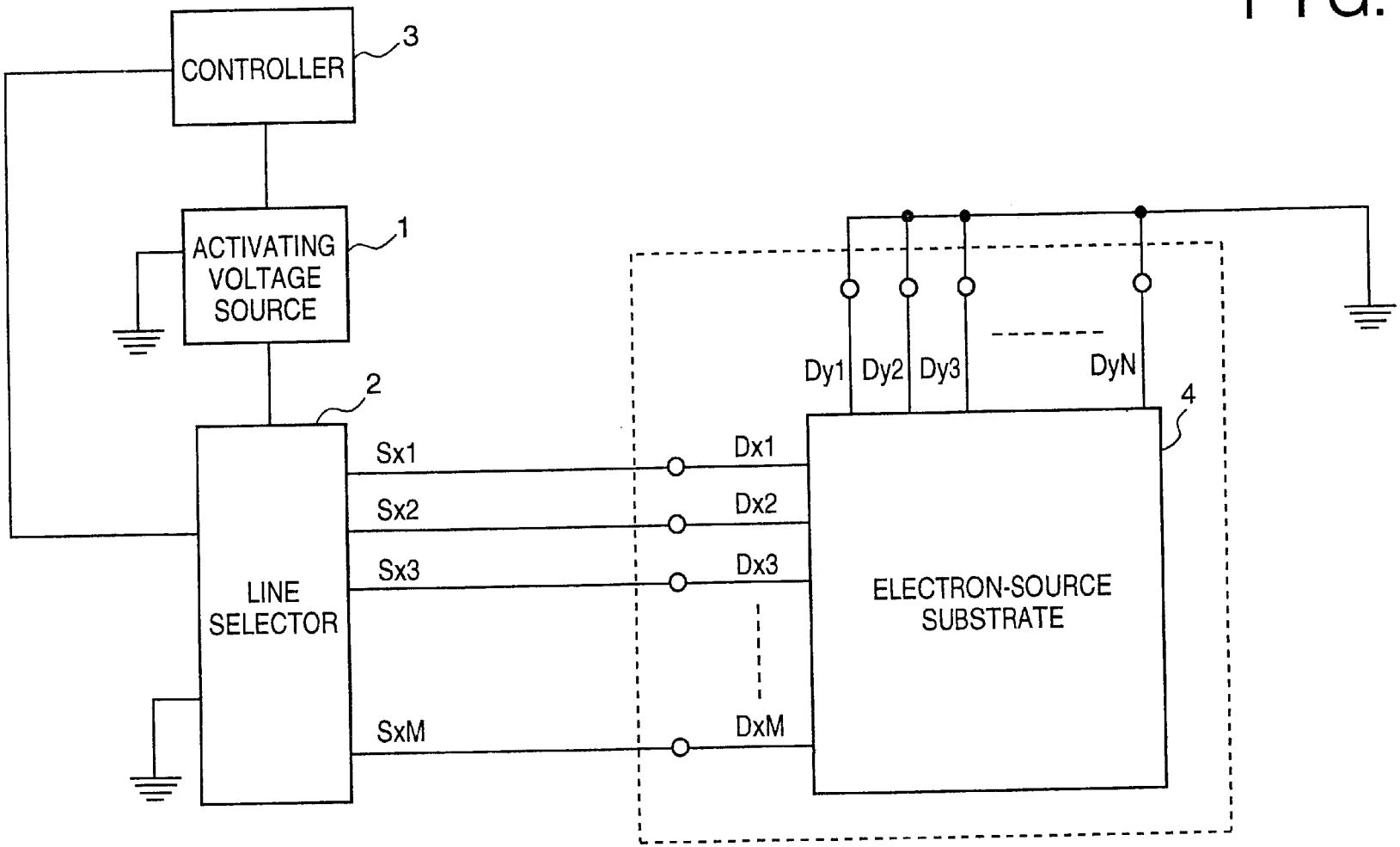
FIG. 1 is a block diagram showing the construction of an activating device of a multi SCE type electron-emitting device according to a first embodiment of the present invention.

FIG. 1 shows an activating device for activating the SCE type electron-emitting device according to a first embodiment. In FIG. 1, numeral 1 denotes an activation voltage source which generates an activating voltage pulse; 2, a line selector for selecting a line to apply the voltage pulse generated by the activation voltage source 1; 3, a controller which controls the activation voltage source 1 and the line selector 2; and 4, an electron-source substrate to be activated, on which a plurality of SCE type electron-emitting devices which have been forming-processed are arranged in a M×N simple matrix. The electron-source substrate 4 is provided in a vacuum device (not shown) which has $10^{-4}$ to $10^{-5}$ Torr vacuum condition.

Figure 21:
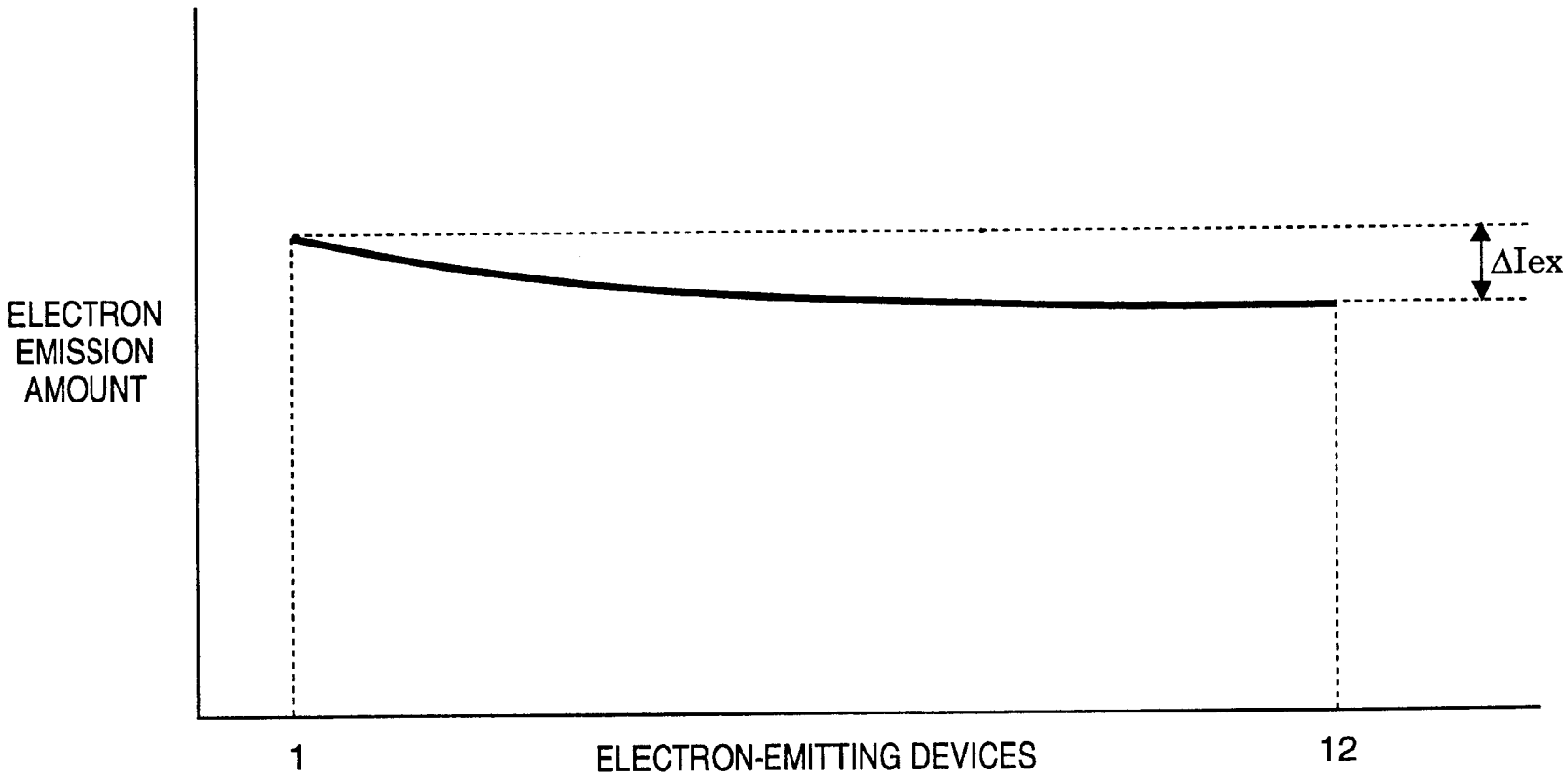
FIG. 21 is a graph showing distribution of electron emission amount upon completion of a first activating process according to the fourth embodiment.

Hereinafter, a method for activating the SCE type electron-emitting device according to the first embodiment will be described with reference to FIG. 1. The activation voltage source 1 is used for generating a voltage pulse necessary for activation. The output voltage waveform of the activation voltage source 1 is shown in FIG. 21, where the pulse width T1 is 1 msec, the pulse interval T2 is 2 msec, and the voltage wave peak value is 14V. The controller 3 controls the activation voltage source output. The output voltage is inputted into the line selector 2 and applied to a selected line.

Figure 2:
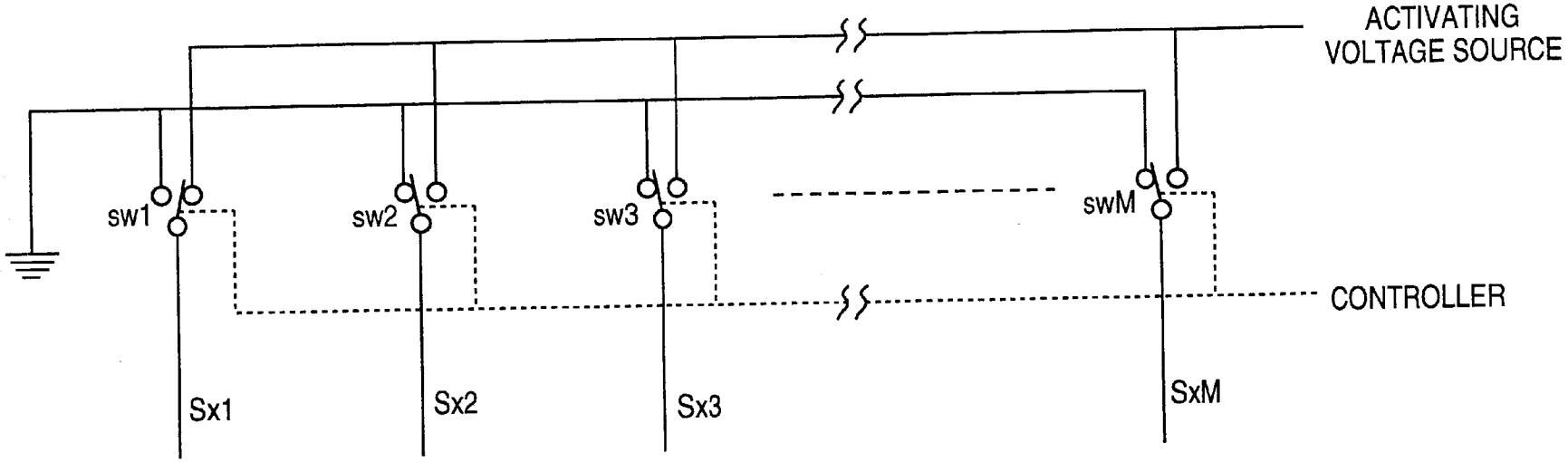
FIG. 2 is a detailed illustration of a line selector in FIG. 1.

The operation of the line selector 2 will be described with reference to FIG. 2. The line selector 2 comprises switches such as relay switches or analog switches. When the electron-beam source substrate 4 has an N×M matrix, M switches are arranged in parallel as sw1 to swM, and connected to x-wire terminals Dx1 to DxM of the electron-source substrate 4 via lines Sx1 to SxM. The switches sw1 to swM operate to apply the voltage from the activation voltage source 1 to a line to be activated under the control of the controller 3. In FIG. 2, the switch sw1 is activated to select the first line, and the other lines are connected to the ground.

Figure 3:
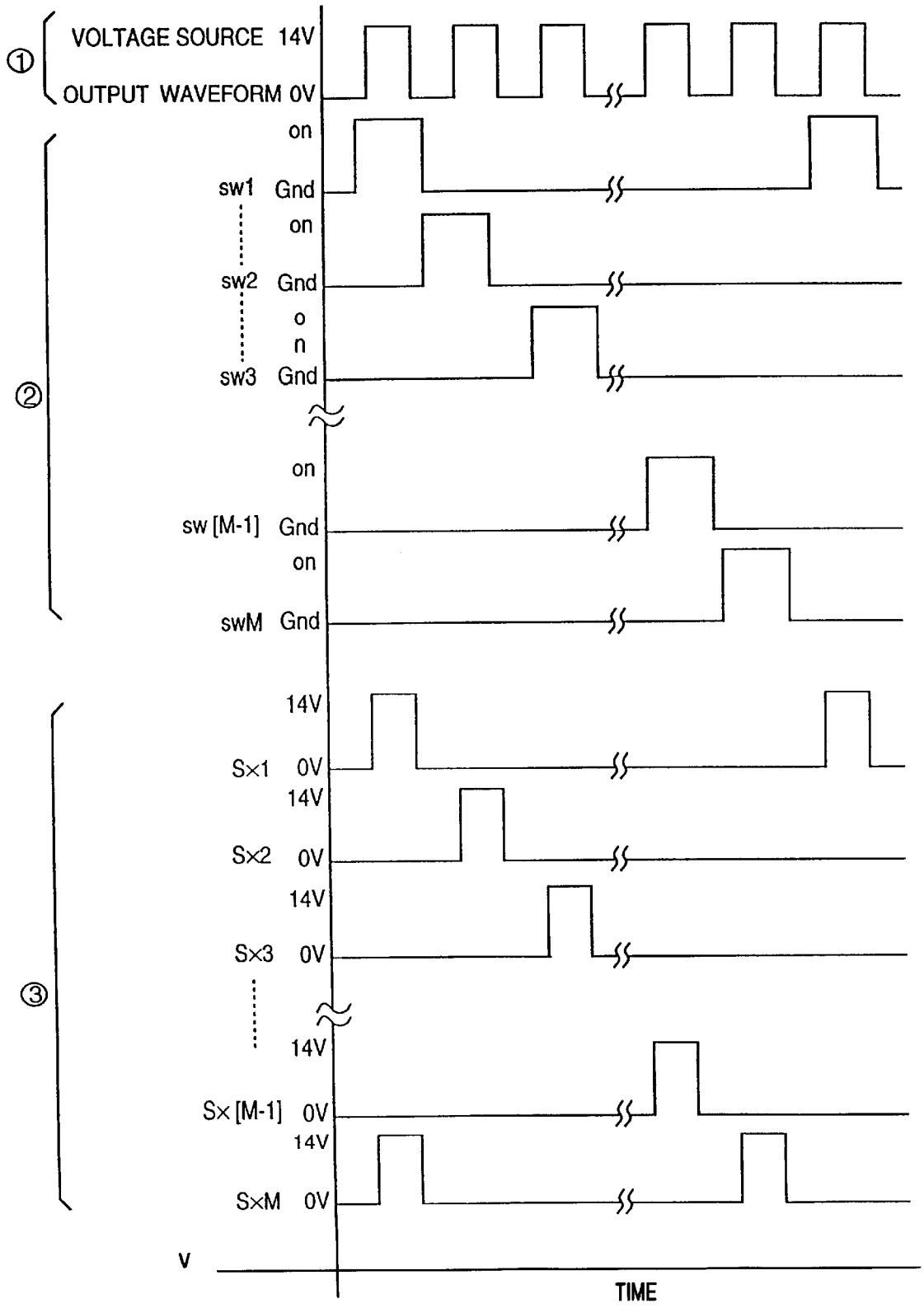
FIG. 3 is a timing chart showing timings of line switching according to the first embodiment.

Next, line-switching timing of this embodiment will be described with reference to FIG. 3 which is a timing chart showing operation timings of the activation voltage source 1 and the line selector 2 in FIG. 1. In FIG. 3, the top line indicates an output waveform of voltage from the activation voltage source 1; lines sw1 to swM, operation timings of the switches in the line selector 2; and lines Sx1 to SxM, output waveforms of voltage from the line selector 2.

As shown in FIG. 3, the activation voltage source 1 continuously outputs a rectangular pulse. As the pulse-output starts, first the switch sw1 is turned on, and the switch sw1 outputs the pulse to the terminal Dx1 of the electron-source substrate 4. However, the switch sw1 is turned on for only one pulse width. Immediately after the switch sw1 is turned off, the switch sw2 is turned on. In this manner, the switches sw1 to swM are sequentially turned on in accordance with the pulse output, and the respective output pulses indicated by Sx1 to SxM are applied to the terminals Dx1 to DxM. This operation is repeated from the switch sw1.

As a result of activation for a predetermined period, the emission current characteristics of the respective SCE type electron-emitting devices become uniform, which obtains high-quality images at the image display apparatus manufactured utilizing the electron-beam source having the SCE type electron-emitting devices. Time necessary for the activation processing is calculated from data on activation of one line. In comparison with the activation by each line, period needed to obtain the same emission current as in the independent activation by each line can be reduced to about ⅕.

As described above, the application of voltage while line-scanning with respect to a plurality of SCE type electron-emitting devices, using the activating device can reduce activation period and further uniform characteristics of the respective devices.

Note that the present embodiment can be applied to the electron-source substrate 4 where a plurality of SCE type electron-emitting devices are connected with a ladder wiring.

[Second Embodiment]

Next, a second embodiment of the present invention will be describe below.

Figure 4:
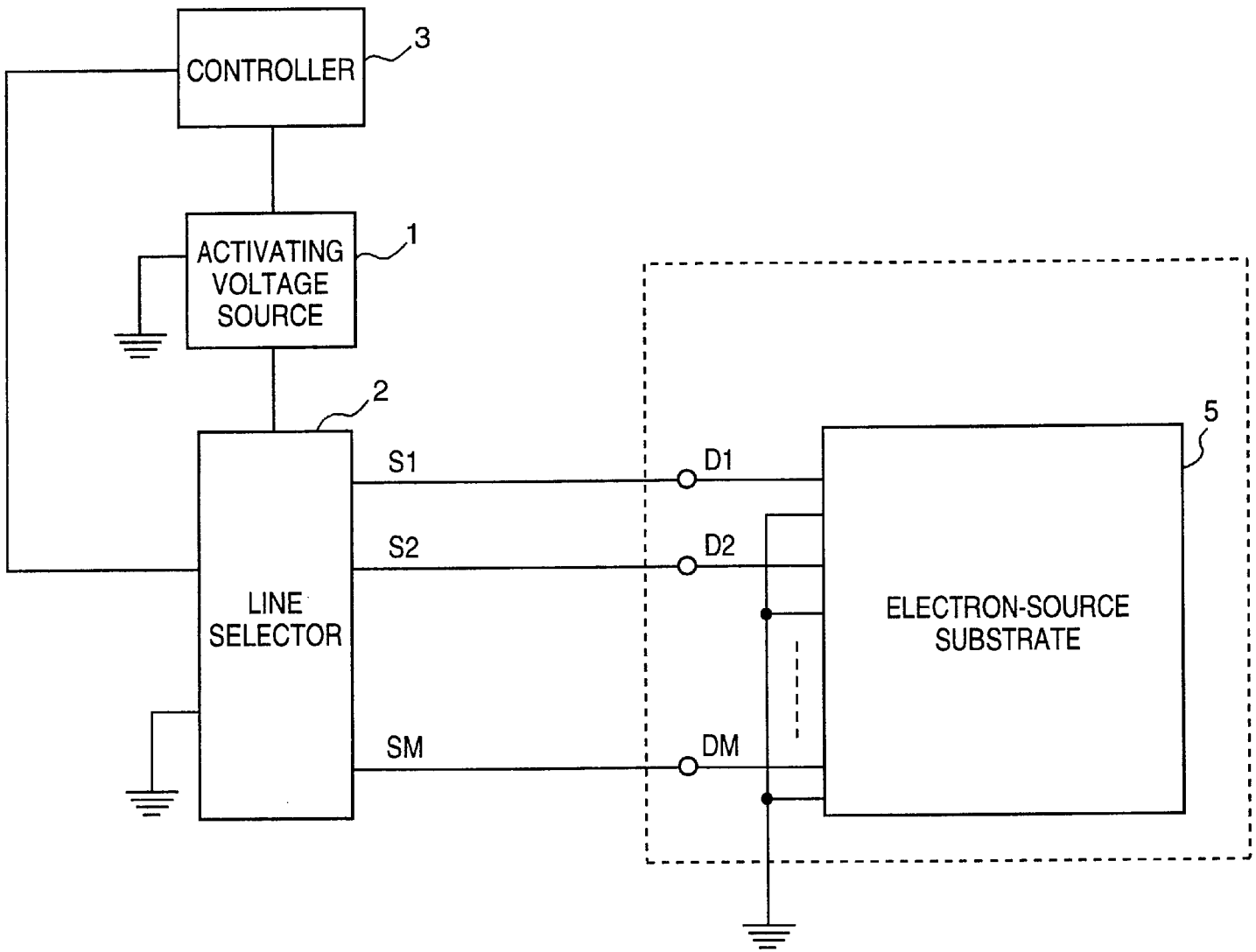
FIG. 4 is a block diagram showing the construction of the activating device of the multi SCE type electron-emitting device according to a second embodiment of the present invention.

The activating device according to the second embodiment is the same as that of the first embodiment except that the plurality of SCE type electron-emitting devices which have been already forming-processed are wired in ladder. FIG. 4 shows the construction of the ladder-wired electron-beam source. In FIG. 4, the components corresponding to those in FIG. 1 have the same reference numerals and the explanations of the components will be omitted.

In FIG. 4, numeral 5 denotes an electron-source substrate where the already forming-processed SCE type electron-emitting devices are wired in a ladder. The electron-source substrate 5 is provided in a vacuum device (not shown) which maintains $10^{-4}$ or $10^{-5}$ Torr vacuum condition.

In ladder-wiring, the half of the wires are electrically connected to the line selector 2 via terminals D1 to DM, and the other half of the wires are connected to the ground level (0 volt).

Figure 5:
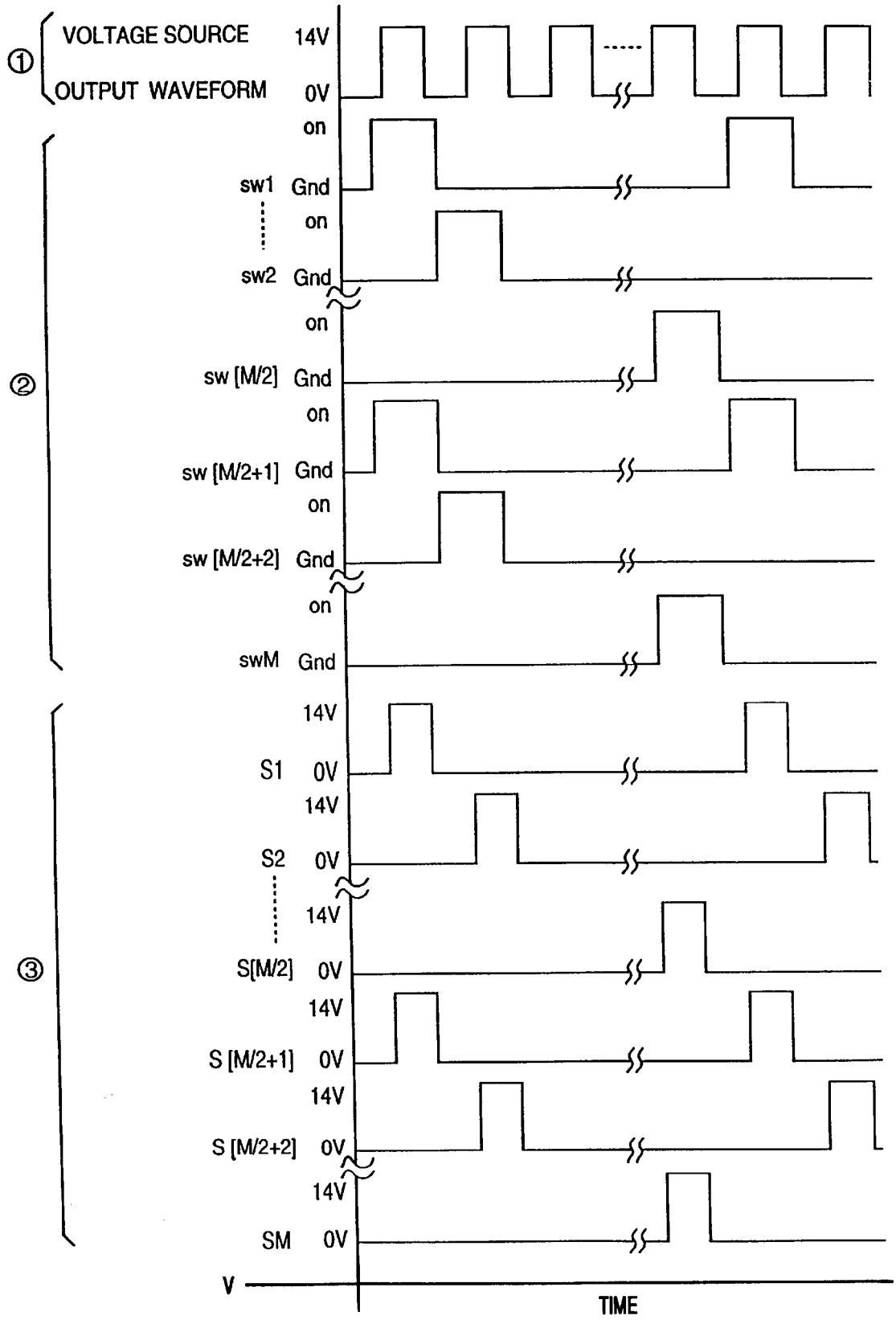
FIG. 5 is a timing chart showing timings of line switching according to the second embodiment.

FIG. 5 is a timing chart showing operation timing of the activation voltage source 1 and the line selector 2 in FIG. 4. In FIG. 5, the top line indicates an output waveform of voltage from the activation voltage source 1; lines sw1 to swM, operation timings of the switches in the line selector 2; and lines S1 to SM, output waveforms of voltage from the line selector 2.

In this embodiment, the lines are divided into two groups, first half (lines 1 to M/2) and second half (lines M/2+1 to M)), and activation processing is performed on these groups in parallel. Within each group, similar to the first embodiment, voltage is applied while sequentially selecting a line. This activation method further reduces processing time in comparison with the first embodiment (note that the number of divided line groups is not limited to two, but it may be appropriately determined in accordance with the number of lines).

The operations of the respective parts are as shown in FIG. 5, where the activation voltage source 1 continuously outputs a rectangular pulse. As the pulse-output starts, the lines sw1 and sw(M/2+1) (when M is an odd number, sw((M+1)/2+1)) is turned on. Accordingly, the pulse is outputted to the terminals D1 and D(M/2+1) of the electron-source substrate 5. However, the lines sw1 and sw(M/2+1) (or sw[(M+1)/2+1]) are on for only one pulse width. Immediately after these lines are turned off, the lines sw2 and sw(M/2+2) (or sw((M+1)/2+2)) are turned on. In this manner, the lines sw1 to sw(M/2), and sw(M/2+1) to swM are sequentially turned on in accordance with the pulse output, and after the respective output pulses have been applied to the terminals D1 to D(M/2) and D(M/2+1) to DM, this operation is repeated from the line sw1, sw(M/2+1) (or sw(M+1)/2+1).

As a result of activation for a predetermined period, the emission current characteristics of the respective SCE type electron-emitting devices become uniform, which obtains high-quality images at the image display apparatus manufactured utilizing the electron-beam source having the SCE type electron-emitting devices. Time necessary for the activation processing is calculated from data on activation on one line. In comparison with the activation by each line, period needed to obtain the same emission current as in the activation by each line can be reduced to about 1/10.

As described above, time of the activation on the overall electron-source substrate can be reduced by increasing lines which receive activation voltage pulses at once. Since too many lines increase electric consumption at the substrate, preferably, the number of lines to be activated is determined in accordance with limitations of heat-generation or electric capacity.

Note that the second embodiment is also applicable to a case where the electron-source substrate 5 has a simple-matrix wired SCE type electron-emitting devices.

[Third Embodiment]

Figure 6:
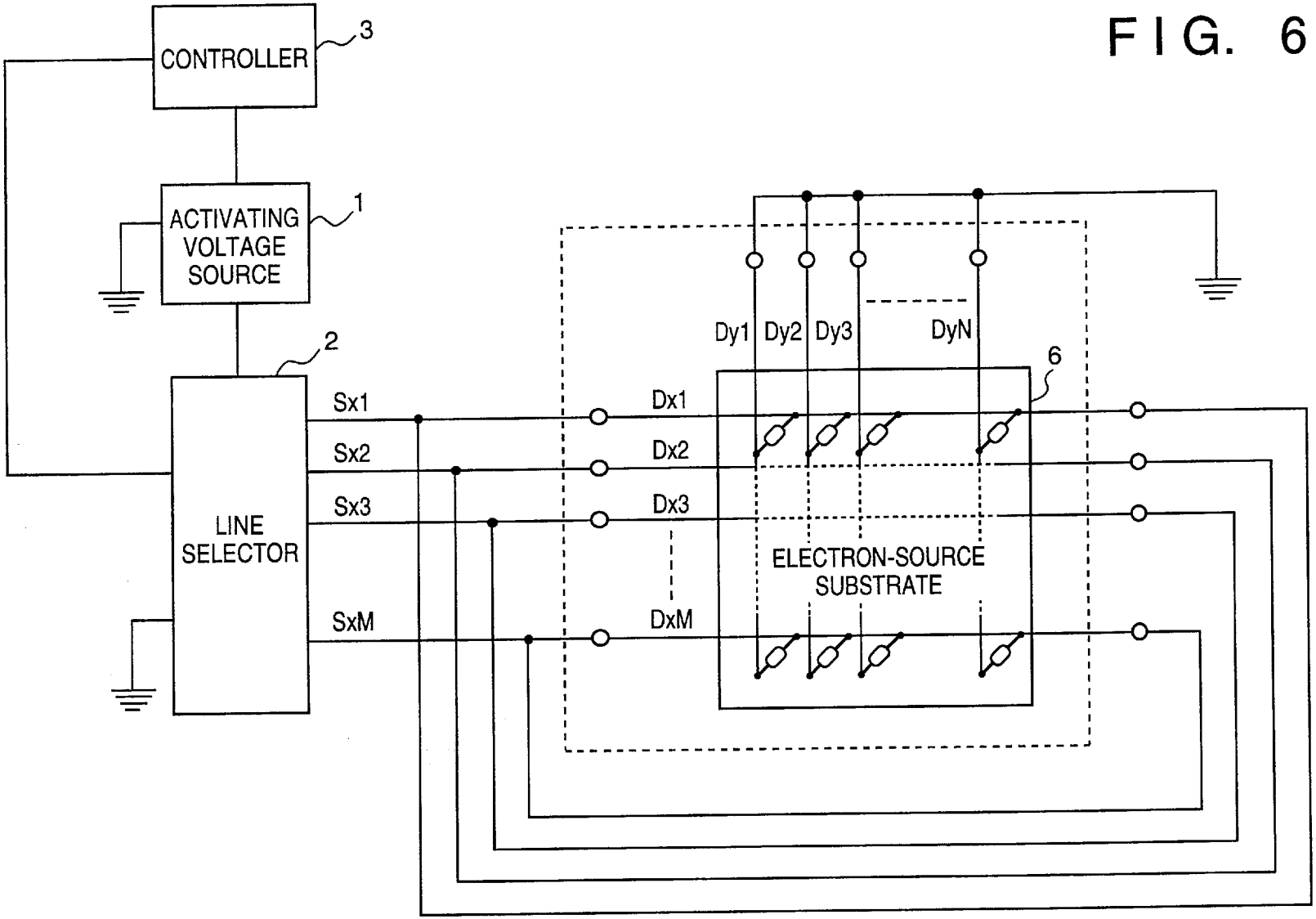
FIG. 6 is a block diagram showing the construction of an activating device of the multi SCE type electron-emitting device according to a third embodiment of the present invention.

Next, a third embodiment of the present invention will be described in detail below. The activating device of this embodiment is similar to that of the first embodiment, where a plurality of SCE type electron-emitting devices are also connected with a simple-matrix wiring. Difference is that the wires are taken out of the both sides of the substrate and commonly connected to the line selector. FIG. 6 shows the construction of the activating device according to the third embodiment. In FIG. 6, the components corresponding to those in FIG. 1 have the same reference numerals and the explanations of the components will be omitted.

In FIG. 6, numeral 6 denotes an electron-beam source substrate where a plurality of SCE type electron-emitting devices which have been already forming-processed are wired in a simple matrix. The electron-beam source substrate 6 is provided in a vacuum device (not shown) which has $10^{-4}$ to $10^{-5}$ Torr vacuum condition. Note that the overall operation of the activating device in FIG. 6 is similar to that in the first embodiment, therefore, the explanation of the operation of the activating device will be omitted.

Figure 7:
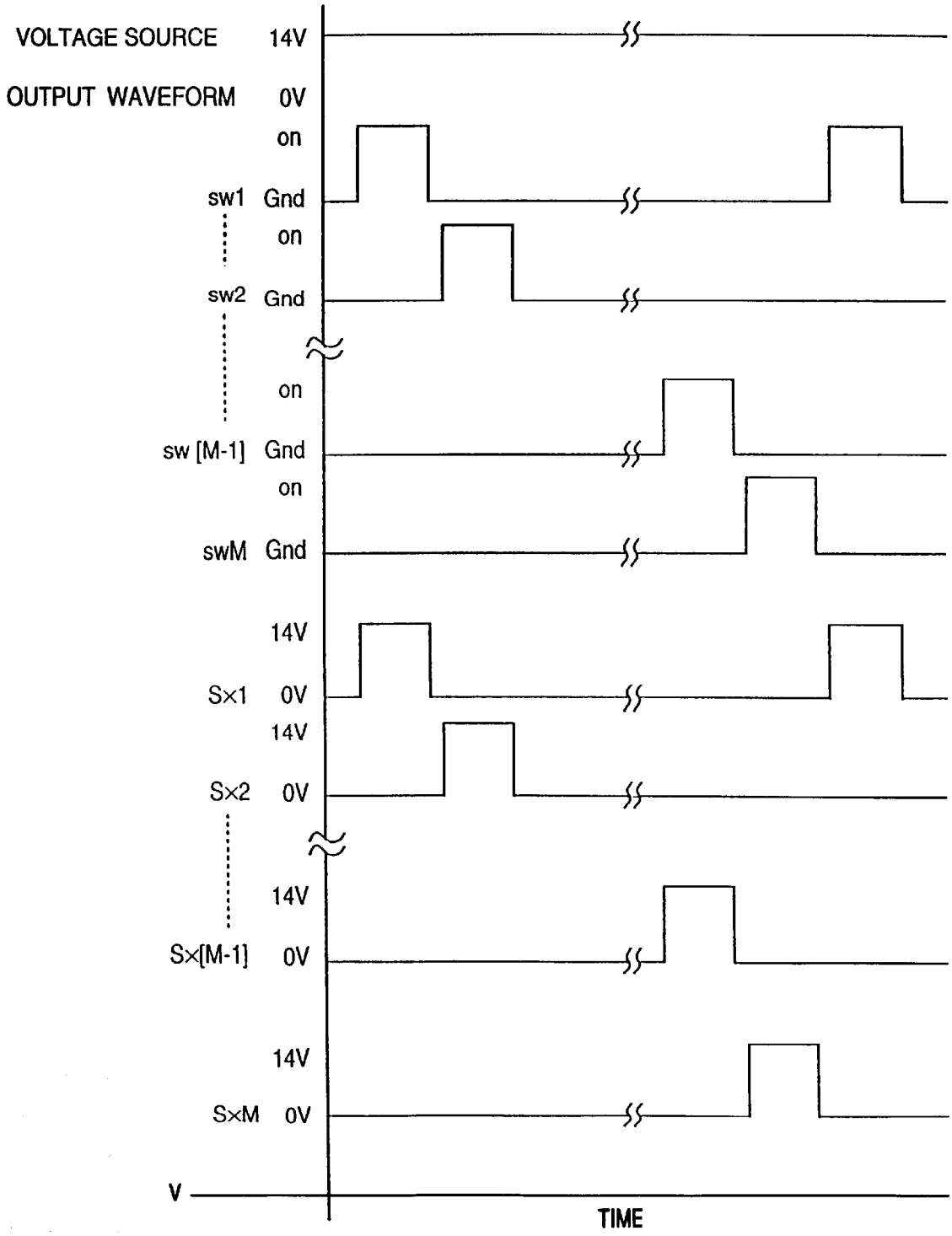
FIG. 7 is a timing chart showing timings of line switching according to the third embodiment.

FIG. 7 is a timing chart showing the operation timings of the activation voltage source 1 and the line selector 2 in FIG. 6. In FIG. 7, the top line indicates an output wave form of voltage from the activation voltage source 1; lines sw1 to swM, operation timings of the switches in the line selector 2; and lines Sx1 to SxM, output waveforms of voltage from the line selector 2.

In the third embodiment, the activating device 1 comprises a simple-structured direct-current voltage source and it outputs constant voltage (14 V in this case).

As the pulse-output starts, first the switch sw1 is turned on, and the switch sw1 outputs the pulse to the terminal Dx1 of the electron-source substrate 6. However, the switch sw1 is turned on for only 1 msec. Immediately after the switch sw1 is turned off, the switch sw2 is turned on. In this manner, the switches sw1 to swM are sequentially turned on by 1 msec, and the respective 1-msec activation voltages are applied to the terminals Dx1 to DxM. This operation is repeated from the switch sw1.

As a result of activation for a predetermined period, the emission current characteristics of the respective SCE type electron-emitting devices become uniform, which obtains high-quality images at the image display apparatus manufactured utilizing the electron-beam source having the SCE type electron-emitting devices.

According to the third embodiment, electricity supply from the both sides of the substrate mitigates voltage degradation caused by wiring resistance. This attains further uniform activation processing. In addition, though the first embodiment performs scanning of M lines for 2×M msec, the present embodiment only needs M msec. Accordingly, the activation processing time becomes about ½ of that of the first embodiment.

As described above, the application of voltage while changing the lines by a predetermined period can reduce the period for activating the overall electron-beam source substrate.

Note that the third embodiment is also applicable to the electron-source substrate 6 where a plurality of SCE type electron-emitting devices are connected with a ladder wiring.

[Fourth Embodiment]

Figure 19:
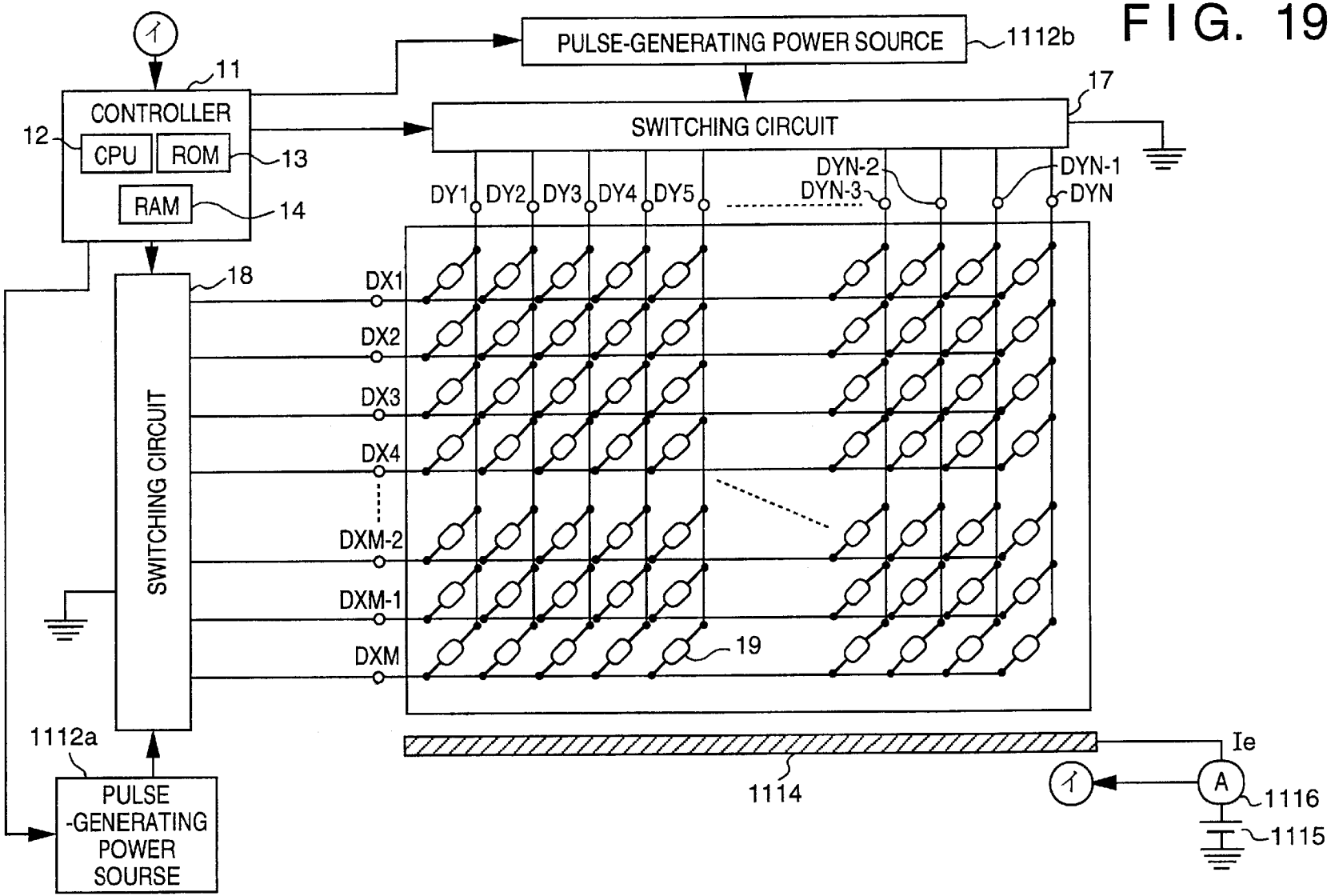
FIG. 19 is a block diagram showing a schematic construction of an electric circuit for performing activation according to a fourth embodiment of the present invention.

FIG. 19 is a block diagram showing the construction of an electric circuit for performing the activation according to a fourth embodiment. In FIG. 19, numeral 19 denotes SCE type electron-emitting devices which have been already forming-processed. The SCE type electron-emitting devices 19 are wired in a M×N simple matrix, constituting an electron-source substrate 10.

Numeral 11 denotes a controller which controls the activation processing of the fourth embodiment. The controller 11 comprises a CPU 12, a ROM 13 and a RAM 14. The CPU 12 realizes the activation processing by executing a control program stored in the ROM 13. The RAM 14 provides a work area to the CPU 12 for executing various processings.

Numerals 17 and 18 denote switching circuits which change connection respectively in column- and row-direction wiring. The switching circuit 17 has a switch device for switching application of activation pulse from a pulse-generating power source 1112*b* to terminals DY1 to DYN connected in the column-direction wiring or to the ground, and a switch device for selecting one or more of the terminals DY1 to DYN for performing activation processing. The switching circuit 18 operates similarly to the switching circuit 17 regarding connection in the row-direction wiring.

The pulse-generating power sources 1112*a* and 1112*b* correspond to the activation power source 1112 described in FIG. 11D. In the activation processing, switching of pulse to be applied to the respective terminals, pulse wave height, pulse width, pulse period, pulse-generating timing etc. are controlled by the controller 11. Note that the pulse-generating power sources 1112*a* and 1112*b* and the switching circuits 17 and 18 may select a plurality of terminals at once.

Numeral 1114 denotes an anode electrode which captures electrons emitted from the respective devices in activation processing; 1116, a galvanometer for measuring the emission current Ie captured by the anode electrode 1114 and outputs the measurement result to the controller 11; 1115, a direct-current (DC) high-voltage power source which applies positive high voltage to the anode electrode 1114. These components 1114 to 1116 corresponding to those in FIG. 11D forms a construction for detecting the emission current Ie.

Figure 20:
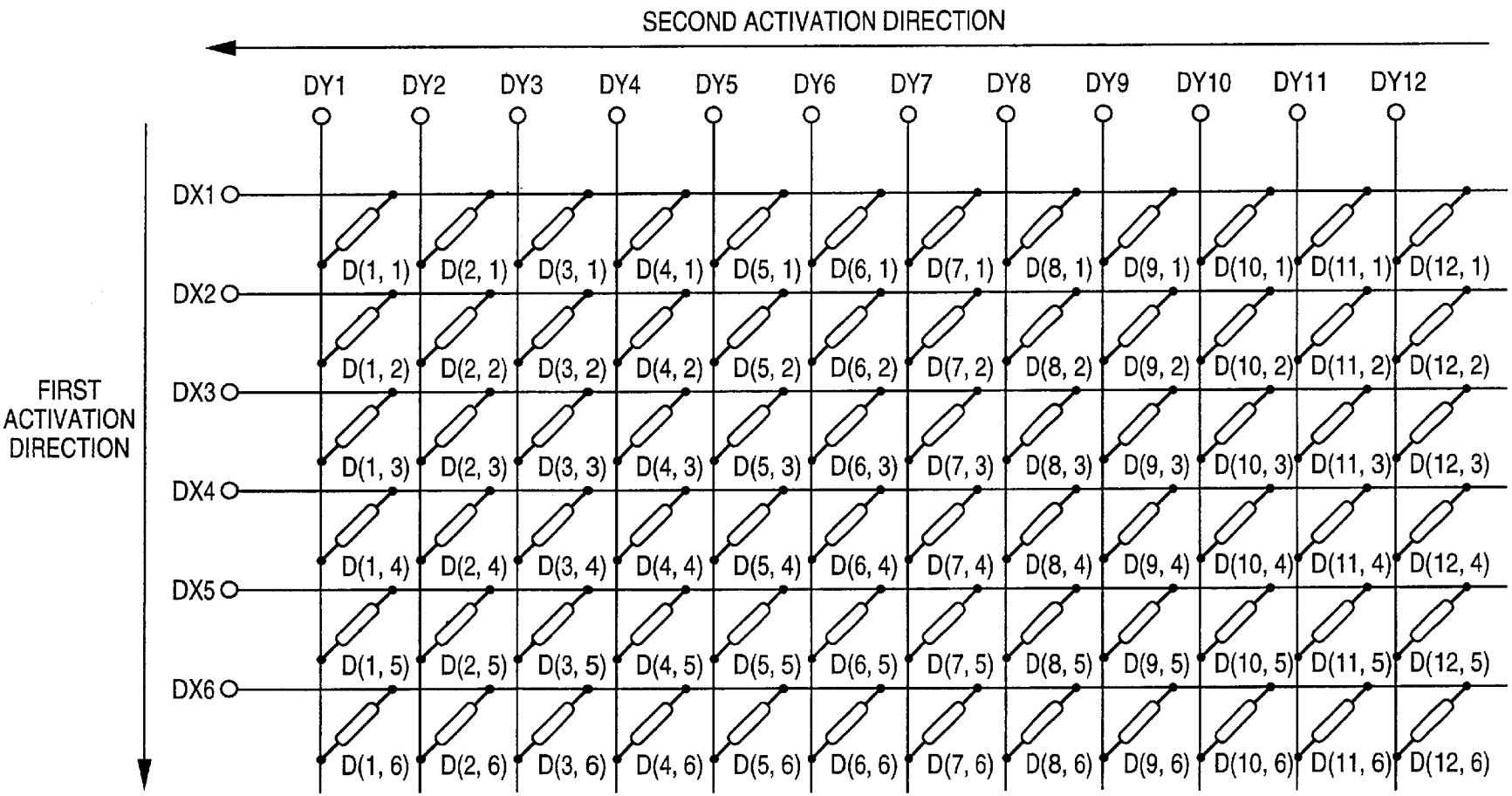
FIG. 20 is an extracted view of 12×6 matrix from a matrix of an electron-beam source 10.

FIG. 20 shows a 12×6 matrix extracted from the M×N matrix of the electron-source substrate 10. For the convenience of illustration, the positions of respective SCE type electron-emitting devices are represented by (X,Y) coordinates such as D(1,1), D(2,1) or D(12,6).

In display panels of private-use TV sets, a horizontal display resolution is higher than a vertical display resolution, and in case of an image display apparatus using the SCE type electron-emitting devices of the present invention, the respective electron-emitting devices correspond to respective luminance points on a display screen. For these reasons, the 12×6 matrix is used as a model similar to an actually-used electron-beam source. Normally, the private-use TV set has a display screen which is long sideways, moreover, the fluorescent surface has a stripe or mosaic color arrangement. In this case, the "N" columns is twice of the "M" lines in FIG. 19.

In this embodiment, activation is performed along the line direction as a first activation process. First, to activate the SCE type electron-emitting devices D(1,1) to D(12,1) connected to a terminal DX1, the switching circuit 18 selects the terminal DX1, and the pulse-generating power source 1112*a* applies an activation pulse. That is, the terminal DX1 is connected to the pulse-generating power source 1112*a* and the other terminals (DX2–DXM, DY1–DYN) are connected to the ground. This can apply voltage only to desired SCE type electron-emitting devices in a simple matrix wiring. The activation pulse has a rectangular waveform as shown in FIG. 13A, wherein the pulse width T1 is 1 msec, the pulse interval T2 is 10 msec, and a rectangular-wave voltage Vac is 14 V. The activation is performed in about $1\times10^{-5}$ Torr vacuum atmosphere. During the activation, the emission current Ie is monitored, and the processing is continued until the emission current Ie has been completely saturated (90 min in this embodiment).

Next, to activate the respective SCE type electron-emitting devices D(1,2) to D(12, 2) connected to a terminal DX2, the switching circuit 18 selects the terminal DX2. That is, the terminal DX2 is connected to the pulse-generating power source 1112*a*, and the other terminals are connected to the ground, thus activation pulses are applied to the terminal DX2.

In FIG. 20, this operation is repeated to the bottom line terminal DX6, activating by one line (first activation process). Note that during the activation processing on each line, the emission current Ie is monitored, and the activation processing is completed when the saturation of the emission current Ie is detected. The detection of saturation of the emission current Ie is made by detecting that change amount of the Ie has become a predetermined amount or less.

When the first activation process as described above has been completed, the difference of the distance among the electricity-supply terminals has caused non-uniformity of application voltages to the respective devices within the line (horizontal line in FIG. 20), as shown in FIG. 33. FIG. 21 shows the non-uniformity of the emission current amount within a line at the completion of the first activation process. The non-uniformity of the emission current as shown in FIG. 33 has caused the difference ΔIex in the emission characteristics.

Next, as a second activation process, the activation processing is continued along the wiring orthogonal to the direction of the first activation. That is, as the first activation process is made along the line direction, the second activation process is made along the column direction (the vertical direction in FIG. 20).

First, to activate the respective SCE type electron-emitting devices D(12,1) to D(12,6) connected to the terminal DY12, the switching circuit 17 selects the terminal DY12. As a result, the terminal DY12 is connected to the pulse-generating power source 1112*b*, and the other terminals (DY1–DYN–1, DX1–DXM) are connected to the ground. Then, activation pulses on the same activation conditions as those in the first activation process are applied to the terminal DY12.

In this manner, the second activation process is performed to the left most terminal DY1. In the second activation process, the already-activated SCE type electron-emitting devices are driven, the activation period is short (15 min in this embodiment) while the difference of emission current due non-uniformity of applied voltage is corrected.

Figure 22:
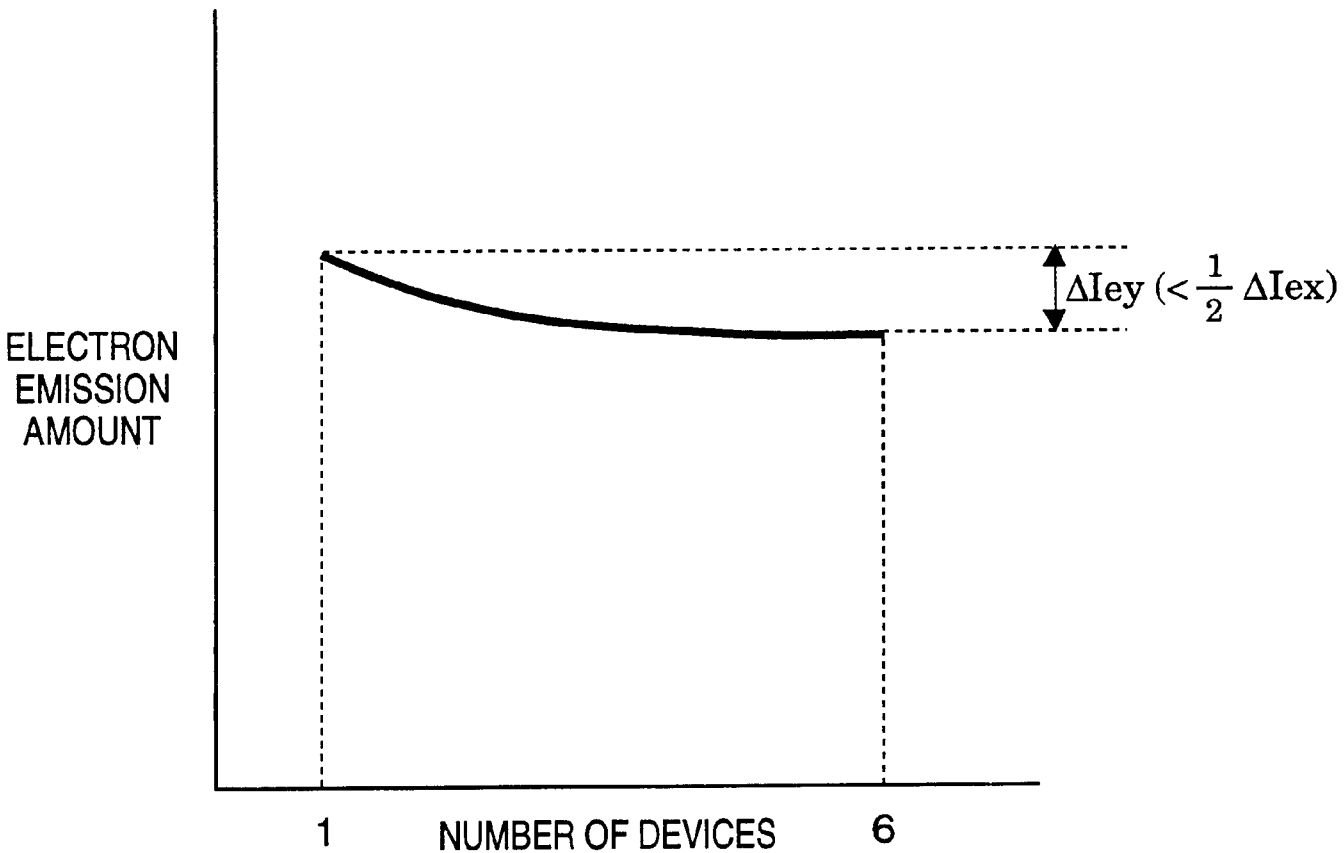
FIG. 22 is a graph showing dispersion of emission current amount at devices in a column-direction after execution of a second activating process.

FIG. 22 shows the dispersion of emission current of the devices in the column direction after the second activation process. At the SCE type electron-emitting devices in the vertical direction, i.e., the devices connected to the terminal DYN, in comparison with the first activation process, the number of SCE type electron-emitting devices driven on one line decreases from 12 to 6, the degradation of voltage due to wiring can be mitigated. As shown in FIG. 22, the dispersion of electron emission amount is reduced to the half or less than the dispersion amount at the first activation process.

Note that if the above-described second activation process is performed first, the dispersion of electron emission amount can also be reduced, however, activation from the initial stage takes long. For this reason, the first activation is first performed along a direction where lines are fewer. As a result, the activation period can be reduced. For example, in the present embodiment, the first activation requires about 90 min, while the second activation requires only about 15 min. Accordingly, the processing time can be reduced by performing the first activation process along a direction where the lines are fewer and then performing the second activation process along the direction orthogonal to the first activation direction.

The activation processing upon the entire matrix as shown in FIG. 19 can form an electron-beam source having a uniform current emission.

Note that the above activation conditions are preferable to the SCE type electron-emitting devices of the present embodiment. If the design of the SCE type electron-emitting devices is changed, the activation conditions should be changed in accordance with the change of design.

Note that the activation method is not limited to the above first and second activation processes, but other methods, e.g., simultaneous activation of plural lines, or activation by scanning may be adopted. Further, even if the row direction and the column direction are opposite to each other, the second activation may be performed along the direction where the devices on one line are fewer.

Figure 23:
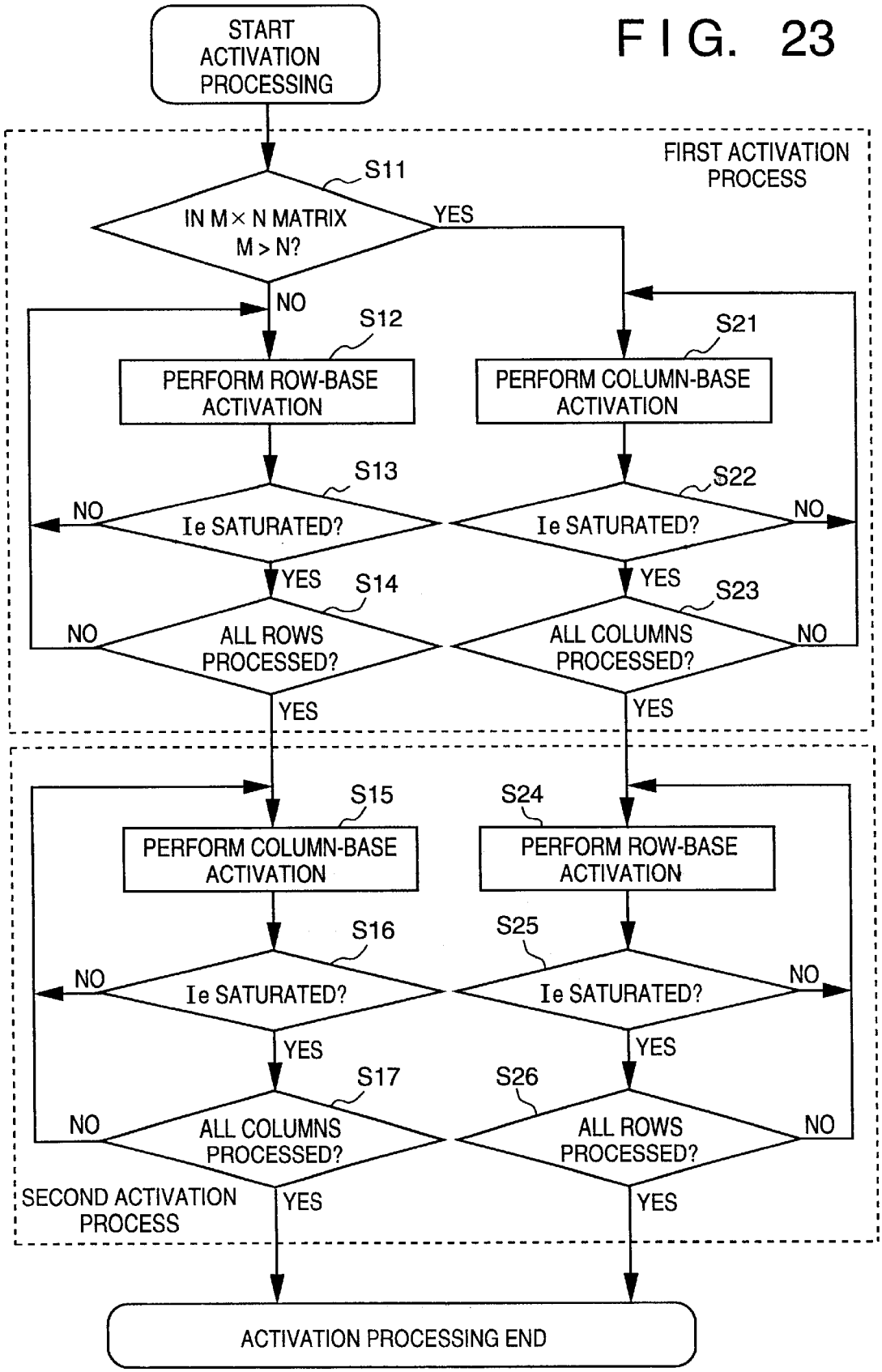
FIG. 23 is a flowchart showing the activating process procedure according to the fourth embodiment.

FIG. 23 is a flowchart showing activation process procedure according to the present embodiment. In FIG. 23, the first activation process is shown at steps S11, S12 to S14, S21 to S23, and the second activation process is shown at steps S15 to S17 and S24 to S26.

To determine the first activation process in row units or column units, the number M of rows is compared with the number N of columns (within M×N matrix) at step S11. As described above, to reduce process time, the first activation process is performed along the direction where the number of rows/columns is smaller. That is, if the M is less than the N, the process proceeds to step S12, at which line-base activation process is performed. Then at step S13, whether or not the emission current Ie has been saturated is determined, and if NO, the activation process is continued till the emission current saturation is detected. This process is performed on all the lines. At step S14, if it is determined that all the lines have been processed, the process proceeds to step S15, to advance to the second activation process.

At step S15, column-base activation process is performed till saturation of the emission current Ie is detected (S16). As the activation at steps S15 and S16 has been performed with respect to all the columns (S17), this activation process ends.

On the other hand, if it is determined at step S11 that the number N of the columns is smaller than the number M of the rows, the process proceeds to step S21. In the processing shown at steps S21 to S26, to perform a process similar to the above process shown at steps S12 to S17, except that the first activation process is performed in column units and the second activation process is performed in row units.

Note that in this embodiment, a control program for realizing the control as shown in the flowchart of FIG. 23 is stored in the ROM 13 and is executed by the CPU 12. However, the control is not limited to this arrangement. For example, the construction for realizing the above control can be formed with hardware such as a logic circuit.

As described above, activation process in line units and activation process in column units can obtain uniform electron emission characteristics of a matrix-wired SCE type electron-emitting devices.

As the first activation process is performed along a direction where the number of rows/columns is smaller, the total processing time through the first and second activation processes can be reduced.

[Fifth Embodiment]

Figure 24:
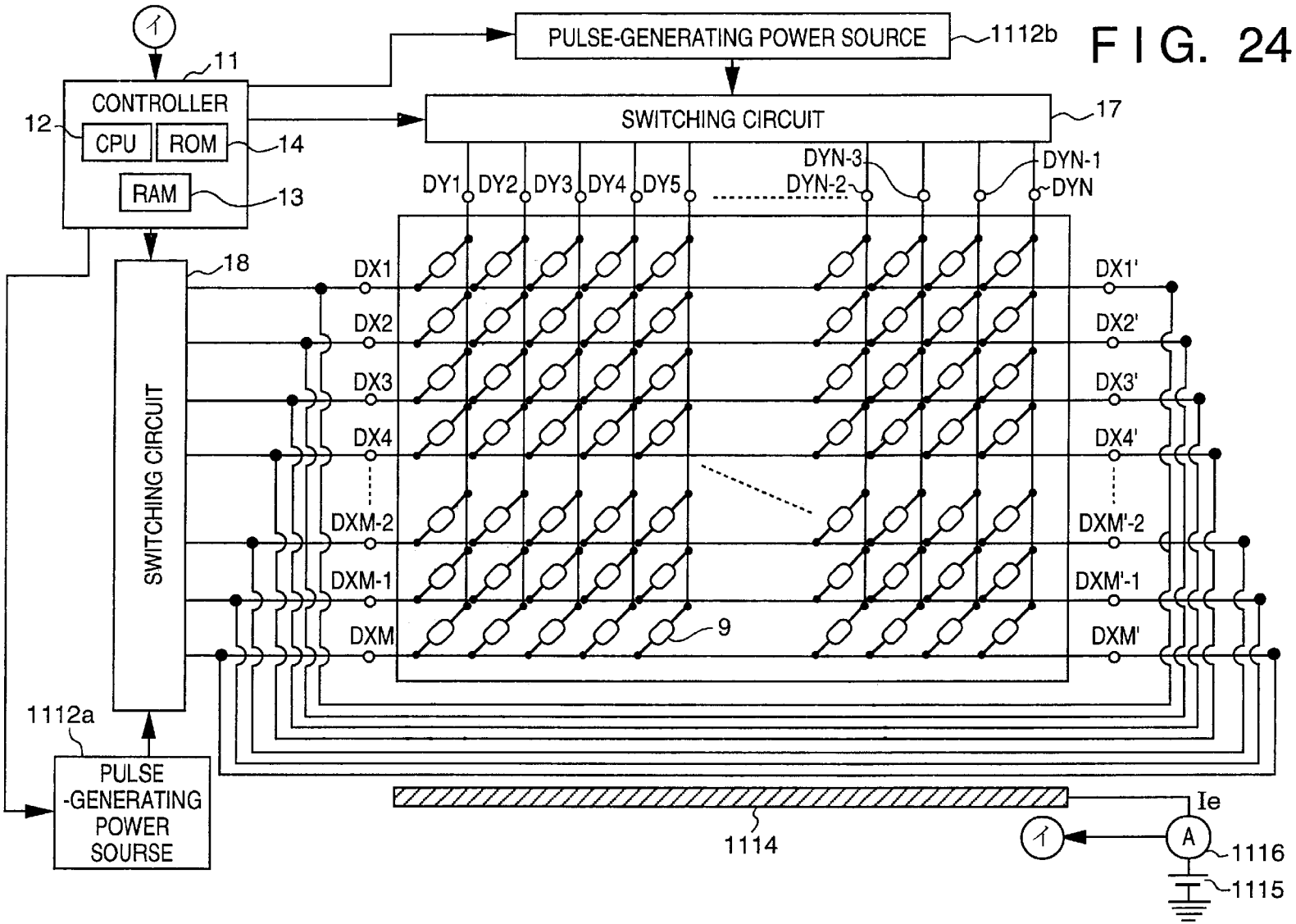
FIG. 24 is a block diagram showing the schematic construction of an electric circuit for activating processing according to a fifth embodiment of the present invention.

Next, a fifth embodiment of the present invention will be described with reference to FIGS. 24 and 25. FIG. 24 is a block diagram showing the construction of an electric circuit for performing activation processing according to the fifth embodiment. Difference from the fourth embodiment (FIG. 19) is that the circuit has terminals for applying activation pulses (electricity-supply terminals), DX1' and DX1 to DXM' and DXM, at the both sides of the row-direction wires. Note that in FIG. 24, the components corresponding to those in FIG. 19 have the same reference numerals and the explanations of the components will be omitted.

Similar to the fourth embodiment, the method of activation according to the present embodiment is, on the assumption that the number of rows is smaller than that of columns, to perform the first activation process in row units, and perform the second activation process in a direction orthogonal to the rows processed in the first activation process, i.e., in column units. Note that in comparison with the first activation according to the fourth embodiment, voltage degradation in the first activation is mitigated, since electricity-supply terminals are provided at the both sides of row-direction wires.

Figure 25:
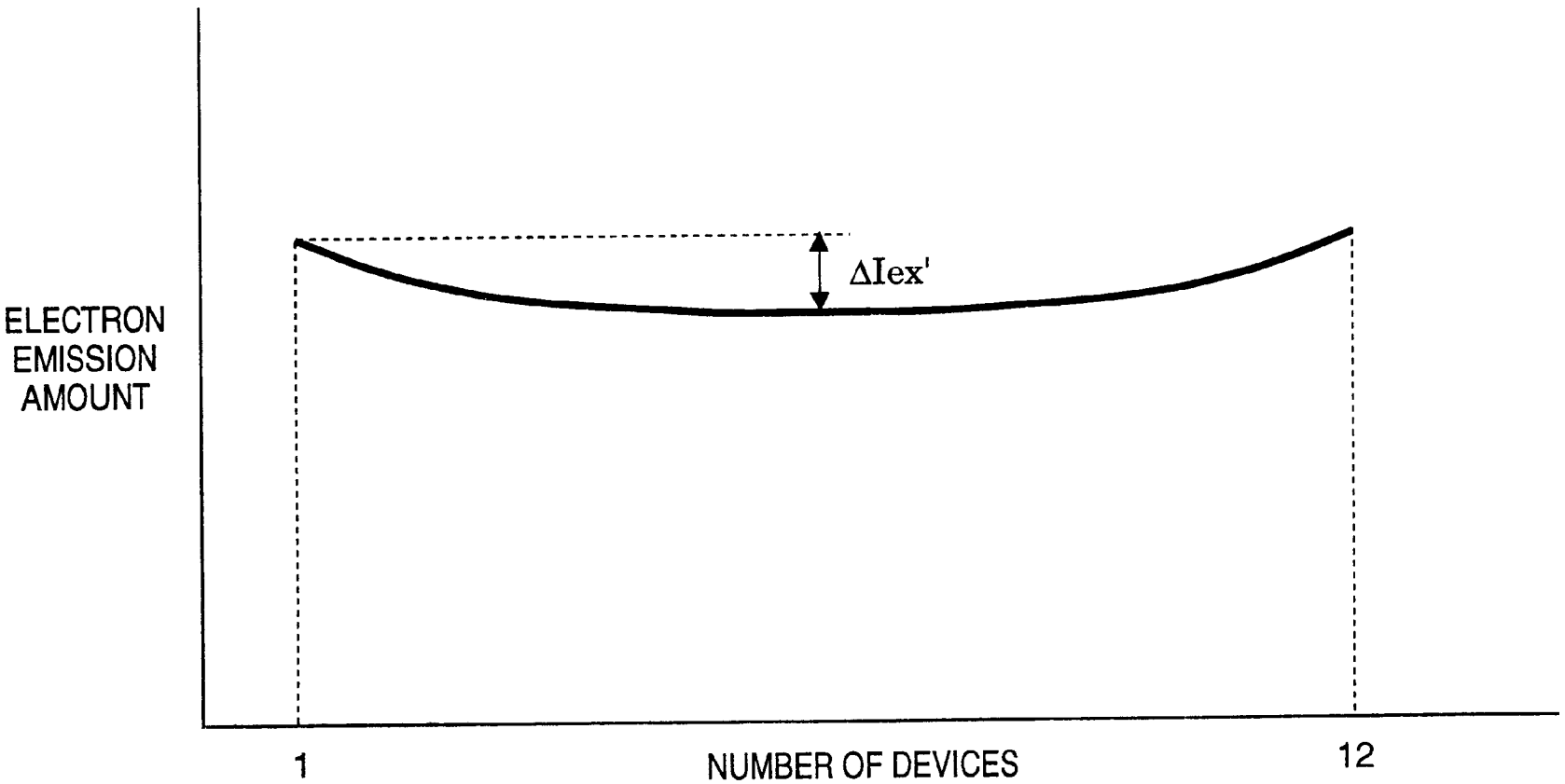
FIG. 25 is a graph showing emission current amount from each device in a column-direction.

FIG. 25 shows the uniformity of emission current from the respective first-activation processed devices. After the above first activation process, the difference between the electron-emitting characteristics of the electron-source substrate in the row direction is ΔIeX' which is even smaller than the dispersion amount ΔIeX shown in FIG. 21.

Note that the selection of the SCE type electron-emitting devices to be activated, activation conditions such as activation atmosphere and activation pulses are similar to those in the fourth embodiment. The first activation process is performed in order of DX1, DX2, . . . , DXM, and the second activation process is performed in order of DYN/2, DY(N/2+1), DY(N/2−1) . . . , DY1, DYN, i.e., in descending order from the column connected to the device having the greatest dispersion amount Δlex. Similar to the fourth embodiment, the activation is terminated when the emission current Ie is saturated. As the first activation process has been completed, the second activation is attained in a short period for correcting the dispersion of application voltage to the respective devices.

By performing the above processing with respect to the entire matrix, an electron-beam source having uniform electron-emitting characteristics can be formed.

Note that the above activation conditions are for the SCE type electron-emitting devices according to the present embodiment. However, if the design of the SCE type electron-emitting devices is changed, it is preferable to change the conditions in accordance with the change of design.

Further, the activation processing of the present embodiment is not limited as above so far as it is line base processing. The activation processing may be performed by plural lines simultaneously or by scanning. Further, the second activation process of the present embodiment is performed from around the center of the line towards the both ends, while the second activation process of the fourth embodiment is performed from one end to the other end of the row/column (right to left in FIG. 20), however, the order of activation is not limited to these orders.

Furthermore, activation processing performed by a method as an appropriate combination of the methods of the fourth and fifth embodiments with methods of the first to third embodiments is especially preferable. The following embodiments are examples of such combinations.

[Sixth Embodiment]

This embodiment employs the combination of the activation method of the first embodiment with the activation method of the fourth embodiment.

In this embodiment, the operation timings of the pulse-generating power sources 1112*a* and 1112*b* and the switching circuits 17 and 18 in FIG. 19 are different from those of the fourth embodiment.

According to the present embodiment, in the first and second activation processes of the fourth embodiment, the pulse-generating power sources 1112*a*, 1112*b* and the switching circuits 17 and 18 operate in accordance with the operation timings of the first embodiment as shown in the timing chart of FIG. 3.

In FIG. 3, the voltage source output waveform (①) corresponds to the output waveform of the pulse-generating power source 1112*a* in FIG. 19; the operation timings of the respective switches (②), to the operation timings of the switches sw1 to swM (or Sw1 to swN), incorporated in the switching circuit 18 (or 17), and connected to the terminals DX1 to DXM (or DY1 to DYN) of the respective lines; and the output waveforms of the line selector (③), to the output waveforms of the switching circuit 18 (or 17) to the terminals DX1 to DXM (or DY1 to DYN) of the respective lines.

In the present embodiment, activation processing similar to that of the fourth embodiment is performed except that the pulse-generating power sources 1112*a*and 1112*b* and the switching circuits 17 and 18 in FIG. 19 operate in accordance with the above timings.

As described above, the present embodiment performs activation in line units and activation in column units, thus attains uniform electron-emitting characteristics of the matrix-wired SCE type electron-emitting devices.

The first activation process, which takes comparatively a long time, is performed in row/column units in accordance with the number of rows/columns, i.e., any of rows and columns of a smaller number. This reduces the total processing time of the first and second activation process.

Further, the present embodiment further reduces activation time and uniforms electron-emitting characteristics of the respective devices by scanning the activation voltage to the SCE type electron-emitting devices.

[Seventh Embodiment]

This embodiment employs the combination of the activation method of the second embodiment with the activation method of the fourth embodiment.

In this embodiment, the operation timings of the pulse-generating power sources 1112*a* and 1112*b* and the switching circuits 17 and 18 in FIG. 19 are different from those of the fourth embodiment.

According to the present embodiment, in the first and second activation processes of the fourth embodiment, the pulse-generating power sources 1112*a*, 1112*b* and the switching circuits 17 and 18 operate in accordance with the operation timings of the second embodiment as shown in the timing chart of FIG. 5.

In FIG. 5, the voltage source output waveform (①) corresponds to the output waveform of the pulse-generating power source 1112*a* (or 1112*b*) in FIG. 1; the operation timings of the respective switches (②), to the operation timings of the switches Sw1 to SwM (or Sw1 to SwN), incorporated in the switching circuit 18 (or 17), and connected to the terminals DX1 to DXM (or DY1 to DYN) of the respective lines; and the output waveforms of the line selector (③), to the output waveforms of the switching circuit 18 (or 17) to the terminals DX1 to DXM (or DY1 to DYN) of the respective lines.

In the present embodiment, activation processing similar to that of the fourth embodiment is performed except that the pulse-generating power sources 1112*a* and 1112*b* and the switching circuits 17 and 18 in FIG. 19 operate in accordance with the above timings.

As described above, the present embodiment performs activation in row units and activation in column units, thus attains uniform electron-emitting characteristics of the matrix-wired SCE type electron-emitting devices.

The first activation process, which takes comparatively a long time, is performed in row/column units in accordance with the number of rows/columns, 67 i.e., any of rows and columns of a smaller number. This reduces the total processing time of the first and second activation process.

Further, the present embodiment further reduces activation time and uniforms electron-emitting characteristics of the respective devices by scanning activation voltage to the SCE type electron-emitting devices and increasing the number of lines to be activated simultaneously.

[Eighth Embodiment]

This embodiment employs the combination of the activation method of the first embodiment with the activation method of the fifth embodiment.

In this embodiment, the operation timings of the pulse-generating power sources 1112*a* and 1112*b* and the switching circuits 17 and 18 in FIG. 19 are different from those of the fifth embodiment.

According to the present embodiment, in the first and second activation processes of the fifth embodiment, the pulse-generating power sources 1112*a*, 1112*b* and the switching circuits 17 and 18 operate in accordance with the operation timings of the first embodiment as shown in the timing chart of FIG. 3.

In FIG. 3, the voltage source output waveform (①) corresponds to the output waveform of the pulse-generating power source 1112*a* (or 1112*b*) in FIG. 19; the operation timings of the respective switches (②), to the operation timings of the switches Sw1 to SwM (or Sw1 to SwN), incorporated in the switching circuit 18 (or 17), and connected to the terminals DX1 to DXM and DX1' to DXM' (or DY1 to DYN) of the respective lines; and the output waveforms of the line selector (③), to the output waveforms of the switching circuit 18 (or 17) to the terminals DX1 to DXM (or DY1 to DYN) of the respective lines.

In the present embodiment, activation processing similar to that of the fifth embodiment is performed except that the pulse-generating power sources 1112*a* and 1112*b* and the switching circuits 17 and 18 in FIG. 19 operate in accordance with the above timings.

As described above, the present embodiment performs activation in row units and activation in column units, thus attains uniform electron-emitting characteristics of the matrix-wired SCE type electron-emmiting devices.

The first activation process, which takes comparatively a long time, is performed in row/column units in accordance with the number of rows/columns, i.e., any of rows and columns of a smaller number. This reduces the total processing time of the first and second activation process.

Further, the present embodiment further reduces activation time and uniforms electron-emitting characteristics of the respective devices by scanning activation voltage to the SCE type electron-emitting devices.

[Modification to Image Display Apparatus]

Figure 26:
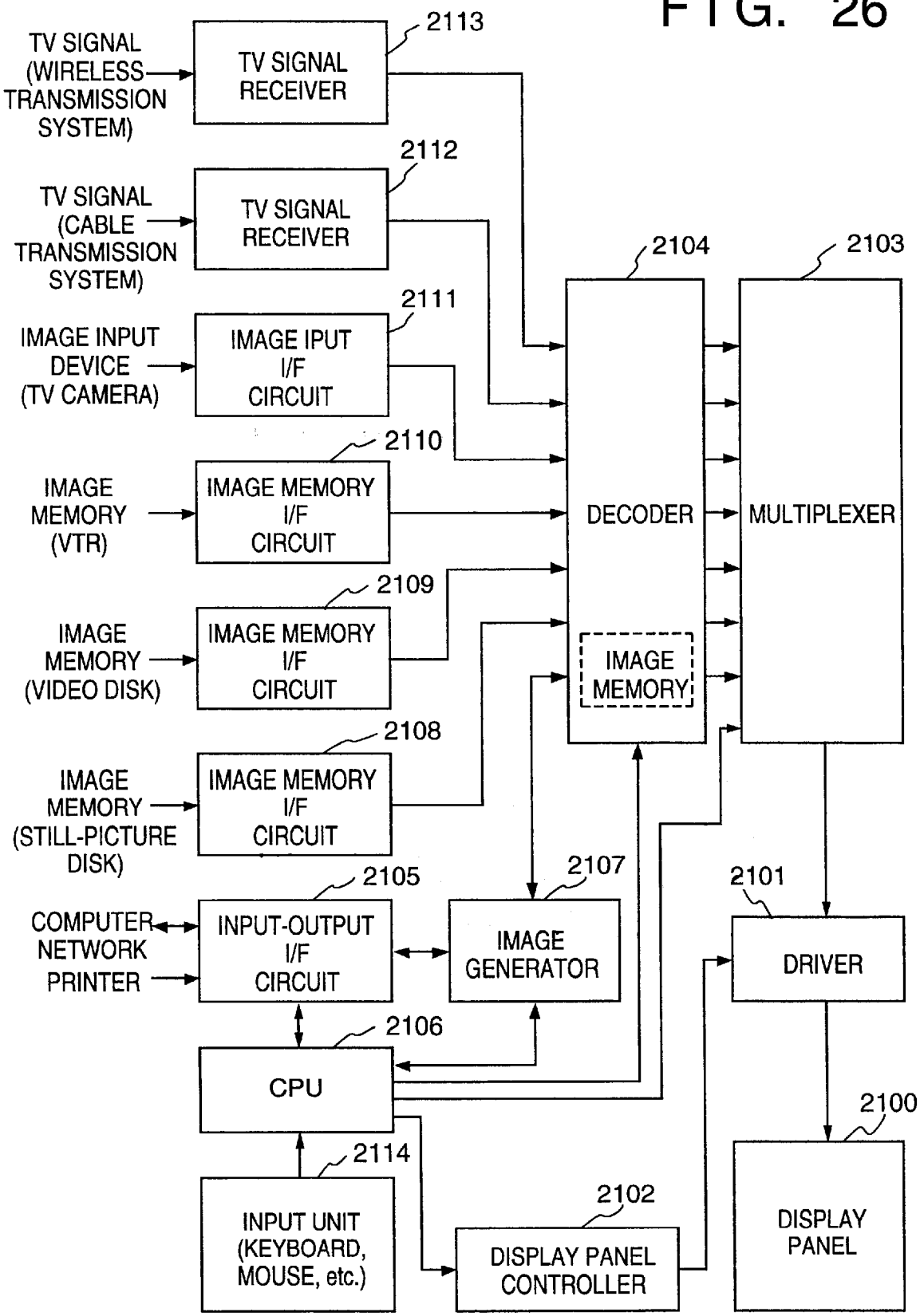
FIG. 26 is a block diagram showing an example of a multifunction display apparatus using the electron-beam source of the embodiments.

FIG. 26 shows an example of a multifunction image apparatus where a display panel, using an electron-beam source with a plurality of activation-processed SCE type electron-emitting devices, displays image information provided from various image information sources such as television broadcasting.

In FIG. 26, numeral 2100 denotes a display panel; 2101, a driver of the display panel 2100; 2102, a display controller; 2103, a multiplexor; 2104, a decoder; 2105, an input-output interface (I/F) circuit; 2106, a CPU; 2107, an image generator; 2108 to 2110, image memory interface (I/F) circuit; 2111, an image input interface (I/F) circuit; 2112 and 2113, TV signal receivers; and 2114, an input unit.

Note that in a case where the display apparatus has received a signal including both video information and audio information, such as a television signal, it reproduces video images and sound simultaneously. In this case, explanations of a speaker and circuits for reception, separation, reproduction, processing and storing regarding the audio information will be omitted since those components are not directly related with the feature of the present invention.

Next, the functions of the respective components will be described below in accordance with the flow of image signal.

The TV signal receiver 2113 receives TV image signals transmitted via a wireless transmission system such as electric wave transmission or space optical transmission. There is no limitation to standards of the TV signal to be received. The TV signals are transmitted in accordance with, e.g., NTSC standards, PAL standards, or SECAM standards. Further, a TV signal having scanning lines more than those in the above television standards (e.g., so-called high-quality TV such as MUSE standards) is a preferable signal source for utilizing the advantageous feature of the display panel applicable to a large display screen and numerous pixels. The TV signal received by the TV signal receiver 2113 is outputted to the decoder 2104.

The TV signal receiver 2112 receives the TV signal transmitted via a cable transmission system such as a coaxial cable system or a optical fiber system. Similar to the TV signal receiver 2113, there is no limitation to standards of the TV signal to be received. Also, the TV signal received by the TV signal receiver 2112 is outputted to the decoder 2104.

Further, the image input I/F circuit 2111 receives image signals supplied from image input devices such as a TV camera or an image reading scanner. Also, the read image signal is outputted to the decoder 2104.

The image memory I/F circuit 2110 inputs image signals stored in a video tape recorder (VTR). Also, the input image signals are outputted to the decoder 2104.

The image memory I/F circuit 2109 inputs image signals stored in a video disk. Also, the input image signals are outputted to the decoder 2104.

The image memory I/F circuit 2108 inputs image signals from a device holding still-picture image data (e.g., so-called still-picture disk). Also, the input still-picture image data are outputted to the decoder 2104.

The input-output I/F circuit 2105 connects the display apparatus to an external computer, a computer network or an output device such as a printer. The input-output I/F circuit 2105 operates for input/output of image data, character information and figure information, and for input/output of control signals and numerical data between the CPU 2106 and an external device.

The image generator 2107 generates display image data based on image data, character information and figure information inputted from an external device via the input-output I/F circuit 2105 or image data, character information or figure information outputted from the CPU 2106. The image generator 2107 has circuits necessary for image generation such as a rewritable memory for storing image data, character information and figure information, a ROM in which image patterns corresponding to character codes are stored and a processor for image processing.

The display image data generated by the image generator 2107 is outputted to the decoder 2104, however, it may be outputted to the external computer network or the printer via the input-output I/F circuit 2105.

The CPU 2106 mainly controls the operation of the display apparatus and operations concerning generation, selection and editing of display images.

For example, the CPU 2106 outputs control signals to the multiplexor 2103 to appropriately select or combining image signals for display on the display panel. At this time, it generates control signals to the display panel controller 2102 to appropriately control a display frequency, a scanning method (e.g., interlaced scanning or non-interlaced scanning) and the number of scanning lines in one screen.

Further, the CPU 2106 directly outputs image data, character information and figure information to the image generator 2107, or it accesses the external computer or memory via the input-output I/F circuit 2105, to input image data, character information and figure information.

Note that the CPU 2106 may operate for other purposes; e.g., like a personal computer or a word processor, it may directly generate and process information.

Otherwise, the CPU 2106 may be connected to the external computer network via the input-output I/F circuit 2105, to cooperate with an external device in, e.g., numerical calculation.

The input unit 2114 is used for a user to input instructions, programs and data into the CPU 2106. The input unit 2114 can comprise various input devices such as a joy stick, a bar-code reader or a speech recognition device as well as a keyboard and a mouse.

The decoder 2104 converts various image signals, inputted from the image generator 2107, the TV signal receiver 2113 and the like, into three-primary-color signals, or luminance signals and I and Q signals. As indicated with a dotted line in FIG. 26, the decoder 2104 preferably comprises an image memory, since decoding of TV signals based on standards of numerous scanning lines, such as MUSE standards, requires an image memory. Further, the image memory enables the decoder 2104 to easily perform image processing such as thinning, interpolation, enlargement, reduction and synthesizing, and editing, in cooperation with the image generator 2107 and the CPU 2106.

The multiplexor 2103 appropriately selects a display image based on a control signal inputted from the CPU 2106. That is, the multiplexor 2103 selects a desired image signal from decode d image signals inputted from the decoder 2104, and outputs the selected image signal to the driver 2101. In this case, the multiplexor 2103 can realize so-called multiwindow television, where the screen is divided into plural areas and plural images are displayed at the respective image areas, by selectively switching image signals within display period for one image frame.

The display panel controller 2102 controls the driver 2101 based on control signals inputted from the CPU 2106.

Concerning the basic operations of the display panel, the display panel controller 2102 outputs a signal to control the operation sequence of the power source (not shown) for driving the display panel to the driver 2101.

Further, concerning the driving of the display panel, the display panel controller 2102 outputs signals to control a display frequency and a scanning method (e.g., interlaced scanning or non-interlaced scanning) to the driver 2101.

In some cases, the display panel controller 2101 outputs control signals concerning image-quality adjustment such as luminance, contrast, tonality and sharpness to the driver 2101.

The driver 2101 generates drive signals applied to the display panel 2100. The driver 2101 operates based on image signals inputted from the multiplexor 2103 and control signals inputted from the display panel controller 2102.

The functions of the respective components are as described above. The construction shown in FIG. 26 can display image information inputted from various image information sources on the display panel 2100.

That is, various image signals such as TV signals are decoded by the decoder 2104, and appropriately selected by the multiplexor 2103, then inputted into the driver 2101. On the other hand, the display panel controller 2102 generates control signals to control the operation of the driver 2101 in accordance with the display image signals. The driver 2101 applies drive signals to the display panel 2100 based on the image signals and the control signals.

Thus, images are displayed on the display panel 2100. The series of these operations are made under control of the CPU 2106.

As the present display apparatus uses the image memory included in the decoder 2104, the image generator 2107 and the CPU 2106, it can not only display images selected from plural image informations, but also perform image processing such as enlargement, reduction, rotation, movement, edge emphasis, thinning, interpolation, color conversion, resolution conversion, and image editing such as synthesizing, deletion, combining, replacement, insertion, on display image information. Although not especially described in the above embodiments, similar to the image processing and image editing, circuits for processing and editing audio information may be provided.

The present display apparatus can realize functions of various devices, e.g., a TV broadcasting display device, a teleconference terminal device, an image editing device for still-pictures and moving pictures, an office-work terminal device such as a computer terminal or a word processor, a game machine etc. Accordingly, the present display apparatus has a wide application range for industrial and private use.

Note that FIG. 26 merely shows one example of the construction of the display apparatus using the display panel having an electron beam source comprising the SCE type electron-emitting devices of the present invention, but this does not pose any limitation on the present invention. For example, in FIG. 26, circuits unnecessary for some use may be omitted. Contrary, components may be added for some purpose. For example, if the present display apparatus is used as a visual telephone, preferably, a TV camera, a microphone, an illumination device, a transceiver including a modem may be added.

In the present display apparatus, as the display panel having the electron beam comprising the SCE type electron-emitting devices can be thin, the depth of the overall display apparatus can be reduced. In addition, as the display panel can be easily enlarged, further it has high luminance and wide view angle, the present display apparatus can display vivid images with realism and impressiveness.

As described above, the present invention can increase the emission current Ie of the electron-beam source having a plurality of electron-emitting devices, and reduce processing time for increasing the Ie. Further, the present invention can uniform the electron-emitting characteristics of the electron-emitting devices. Furthermore, the present invention can improve luminance of an image forming apparatus using the electron-beam source and mitigate dispersion of spotted luminance, thus realize a high-quality image forming apparatus.

The present invention can be applied to a system constituted by a plurality of devices or to an apparatus comprising a single device.

Furthermore, the invention is also applicable to a case where the invention is embodied by supplying a program to a system or apparatus. In this case, a storage medium, storing a program according to the invention, constitutes the invention. The system or apparatus installed with the program read from the medium realizes the functions according to the invention.

The present invention is not limited to the above embodiments and various changes and modifications can be made within the spirit and scope of the present invention. Therefore, to apprise the public of the scope of the present invention, the following claims are made.

What is claimed is:

1. An electron-beam source manufacturing method comprising an activation step of generating activation material at a plurality of electron-emitting devices, by dividing the plurality of electron-emitting devices into plural groups and sequentially applying voltage to each group, with the voltage applied to each group having a plurality of voltage pulses, and wherein during an interval of pulses applied to one group, pulse application is made to other groups.

2. An electron-beam source manufacturing method comprising an activation step of generating activation material at a plurality of electron-emitting devices, by dividing the plurality of electron-emitting devices into plural groups and sequentially applying voltage to each group, wherein said activation step includes a first activation step of generating activation material at the plurality of electron-emitting devices by dividing the electron-emitting devices into a plurality of first groups and sequentially applying voltage to each first group, and a second activation step of generating activation material at the plurality of electron-emitting devices by dividing the electron-emitting devices into a plurality of second groups and sequentially applying voltage to each second group.

3. The electron-beam source manufacturing method according to claim 2, wherein said activation step is performed while detecting emission current of the electron-emitting devices.

4. The electron-beam source manufacturing method according to claim 2, wherein said activation step is completed when saturation of the emission current of the electron-emitting devices is detected.

5. The electron-beam source manufacturing method according to claim 2, wherein the number of electron-emitting devices of each of the first groups is greater than that of each of the second groups, and wherein the first activation step is performed before the second activation step.

6. The electron-beam source manufacturing method according to claim 2, wherein at the first and second activation steps, the application of voltage sequentially made by each group is repeated plural times.

7. The electron-beam source manufacturing method according to claim 2, wherein at the first and second activation steps, the voltage applied to each group has a plurality of voltage pulses, and wherein during an interval of pulses applied to one group, pulse application is made to the other groups.

8. The electron-beam source manufacturing method according to claim 2, wherein in each of the first and second groups, the plurality of electron-emitting devices are arranged with a common wire, and wherein the application of voltage is made from both ends of the common wire.

9. The electron-beam source manufacturing method according to claim 2, wherein in each of the first and second groups, the plurality of electron-emitting devices are arranged with a common wire, and wherein the application of voltage is made from one end of the common wire.

10. The electron-beam source manufacturing method according to claim 2, wherein in each of the first and second groups, the plurality of electron-emitting devices are wired in a matrix with a plurality of row-direction wires and a plurality of column-direction wires, and wherein the application of voltage at the first activation step is sequentially made by each row-direction wire, and the application of voltage at the second activation step is sequentially made by each column-direction wire.

11. The electron-beam source manufacturing method according to claim 10, wherein said activation step is performed while detecting emission current of the electron-emitting devices.

12. The electron-beam source manufacturing method according to claim 10, wherein said activation step is completed when saturation of the emission current of the electron-emitting devices is detected.

13. The electron-beam source manufacturing method according to claim 10, wherein the number of column-direction wires is greater than that of row-direction wires, and wherein the first activation step is performed before the second activation step.

14. The electron-beam source manufacturing method according to claim 10, wherein at the first and second activation steps, the application of voltage sequentially made by each row-direction wire or each column-direction wire is repeated plural times.

15. The electron-beam source manufacturing method according to claim 10, wherein at any of the first and second activation steps, the application of voltage is made from both ends of the row-direction wire or column-direction wire.

16. The electron-beam source manufacturing method according to claim 10, wherein at any of the first and second activation steps, the application of voltage is made from one end of the row-direction wire or column-direction wire.

17. The electron-beam source manufacturing method according to claim 10, wherein the application of voltage in the second activation step starts from the column wire of the plurality of devices, which is located at the farthest position from terminals applied with voltage during the first activation step, after the processing of said first activation step.

18. A method for manufacturing an image forming apparatus which comprises an image forming unit for forming an image by irradiation of electron beams from an electron-beam source having a plurality of electron-emitting devices, wherein said electron-beam is manufactured by using an activation step of generating activation material at a plurality of electron-emitting devices, by dividing the plurality of electron-emitting devices into plural groups and sequentially applying voltage to each group, wherein the voltage applied to each group has a plurality of voltage pulses, and wherein during an interval of pulses applied to one group, pulse application is made to other groups.

19. The method according to claim 18, wherein said image forming unit includes a fluorescent member.

20. The electron-beam source manufacturing method according to claim 2, wherein each of the plurality of first groups has a plurality of electron-emitting devices and a common wire to which the plurality of electron-emitting devices are connected, wherein the processing of the first activation step is performed before process of the second activation step.

21. The electron-beam source manufacturing method according to claim 20, wherein each of the plurality of second groups has a plurality of devices having substantially the same characteristics produced in said first activation step.

22. The electron-beam source manufacturing method according to claim 20, wherein each of the plurality of second groups has a plurality of devices which has been applied with substantially the same voltage in said first activation step.

23. The electron-beam source manufacturing method according to claim 20, wherein each of the plurality of second groups has a plurality of devices which have substantially the same distance from terminals to which voltage has been applied in said first activation step.

24. The electron-beam source manufacturing method according to claim 20, wherein each of the plurality of second groups has a plurality of devices which are located such that the wiring resistance from terminals to which voltage is applied in said first activation step are substantially the same.

25. An electron-beam source activation method for activating an electron-beam source having a plurality of electron-emitting devices comprising an activation step of generating activation material at a plurality of electron-emitting devices, by dividing the plurality of electron-emitting devices into plural groups and sequentially applying voltage to each group, wherein the voltage applied to each group has a plurality of voltage pulses, and wherein during an interval of pulses applied to one group, pulse application is made to other groups.

26. An electron-beam source activation method for activating an electron-beam source having a plurality of electron-emitting devices comprising an activation step of generating activation material at a plurality of electron-emitting devices, by dividing the plurality of electron-emitting devices into plural groups and sequentially applying voltage to each group, wherein said activation step includes a first activation step of dividing the plurality of electron-emitting devices into a plurality of first groups and sequentially applying voltage to each first group, and a second activation step of dividing the plurality of electron-emitting devices into a plurality of second groups and sequentially applying voltage to each second group.

27. The electron-beam source activation method according to claim 26, wherein in each of the first and second groups, the plurality of electron-emitting devices are arranged with a common wire, and wherein the application of voltage is made from one end of the common wire.

28. The electron-beam source activation method according to claim 26, wherein said activation step is performed while detecting emission current of the electron-emitting devices.

29. The electron-beam source activation method according to claim 26, wherein said activation step is completed when saturation of the emission current of the electron-emitting devices is detected.

30. The electron-beam source activation method according to claim 26, wherein the number of electron-emitting devices of each of the first groups is greater than that of each of the second groups, and wherein the first activation step is performed before the second activation step.

31. The electron-beam source activation method according to claim 26, wherein at the first and second activation steps, the application of voltage sequentially made by each group is repeated plural times.

32. The electron-beam source activation method according to claim 26, wherein at the first and second activation steps, the voltage applied to each group has a plurality of voltage pulses, and wherein during an interval of pulses applied to one group, pulse application is made to other groups.

33. The electron-beam source activation method according to claim 26, wherein in each of the first and second groups, the plurality of electron-emitting devices are arranged with a common wire, and wherein the application of voltage is made from both ends of the common wire.

34. The electron-beam source activation method according to claim 26, wherein each of the plurality of first groups has a plurality of electron-emitting devices and a common wire to which the plurality of electron-emitting devices are connected, wherein the processing of the first voltage application step is performed before process of the second voltage application step.

35. The electron-beam source activation method according to claim 34, wherein each of the plurality of second groups has a plurality of devices having substantially the same characteristics produced in said first voltage application step.

36. The electron-beam source activation method according to claim 34, wherein each of the plurality of second groups has a plurality of devices which has been applied with substantially the same voltage in said first voltage application step.

37. The electron-beam source manufacturing method according to claim 34, wherein each of the plurality of second groups has a plurality of devices which have substantially the same distance from terminals to which voltage has been applied in said first voltage application step.

38. The electron-beam source manufacturing method according to claim 34, wherein each of the plurality of second groups has a plurality of devices which are located such that the wiring resistance from terminals to which voltage is applied in said first voltage application step are substantially the same.

39. A method of manufacturing an electron-beam source having a plurality of electron-emitting devices, comprising the steps of:

a first step of generating a carbon or carbon compound material at an electron-emitting device at a predetermined time interval; and a second step of generating, during the interval of the first step of generating carbon or carbon compound material at the electron-emitting device, a carbon or carbon compound material at another electron-emitting device.

40. The method according to claim 39, wherein the first step or the second step is the step of applying a voltage to the electron-emitting device to generate the carbon or carbon compound material.

41. A method of manufacturing an electron-beam source having a plurality of electron-emitting devices, comprising:

a first step of applying a voltage to an electron-emitting device at a predetermined time interval so that an activation material is generated at the electron-emitting device; and a second step of applying a voltage to another electron-emitting device so that an activation material is generated at the another electron-emitting device during the interval of the voltage applying of said first step.

42. The method according to claim 41, wherein the activation material is carbon or carbon compound material.

43. The electron-beam source manufacturing method according to claim 1, wherein in each group, the plurality of electron-emitting devices are arranged with a common wire, and wherein the application of voltage is made from both ends of the common wire.

44. The electron-beam source manufacturing method according to claim 1, wherein in each group, the plurality of electron-emitting devices are arranged with a common wire, and wherein the application of voltage is made from one end of the common wire.

45. The electron-beam source manufacturing method according to claim 1, wherein the plurality of electron-emitting devices are wired in a matrix with a plurality of row-direction wires and a plurality of column-direction wires, and wherein the application of voltage to the plurality of electron-emitting devices is sequentially made by each row-direction wire, and wherein the voltage applied to each row-direction wire has a plurality of voltage pulses, and wherein during an interval of pulses applied to one wire, pulse application is made to other wires.

46. The electron-beam source manufacturing method according to claim 45, wherein the application of voltage is made from both ends of the row-direction wire.

47. The electron-beam source manufacturing method according to claim 45, wherein the application of voltage is made from one end of the row-direction wire.

48. The electron-beam source manufacturing method according to claim 1, wherein the plurality of electron-emitting devices are wired in a matrix with a plurality of row-direction wires and a plurality of column-direction wires, and wherein the application of voltage to the plurality of electron-emitting devices is sequentially made by each column-direction wire.

49. The electron-beam source manufacturing method according to claim 48, wherein the application of voltage is made from one end of the column-direction wire.

50. The electron-beam source manufacturing method according to claim 10, wherein at the first and second activation steps, the voltage applied to each row-direction wire or column-direction wire has a plurality of voltage pulses, and wherein during an interval of pulses applied to one wire, pulse application is made to other wires.

51. The electron-beam source activation method according to claim 25, wherein in each group, the plurality of electron-emitting devices are arranged with a common wire, and wherein the application of voltage is made from both ends of the common wire.

52. The electron-beam source activation method according to claim 25, wherein in each group, the plurality of electron-emitting devices are arranged with a common wire, and wherein the application of voltage is made from one end of the common wire.

* * * * *

UNITED STATES PATENT AND TRADEMARK OFFICE

CERTIFICATE OF CORRECTION

PATENT NO. : 6,336,836 B1
DATED : January 8, 2002
INVENTOR(S) : Noritake Suzuki et al.

It is certified that error appears in the above-identified patent and that said Letters Patent is hereby corrected as shown below:

Title page,
Item [56], References Cited, FOREIGN PATENT DOCUMENTS, "6431332" should read -- 1-31332 --.

Column 7,
Line 4, "2devices" should read -- devices --.

Column 26,
Line 21, "decode d" should read -- decoded --.

Signed and Sealed this

Twenty-fifth Day of March, 2003

JAMES E. ROGAN
*Director of the United States Patent and Trademark Office*